US005688582A

United States Patent [19]

Nagaoka et al.

[11] Patent Number: 5,688,582

[45] Date of Patent: Nov. 18, 1997

[54] BIODEGRADABLE FILAMENT NONWOVEN FABRICS AND METHOD OF MANUFACTURING THE SAME

[75] Inventors: Koichi Nagaoka; Shigetaka Nishimura; Fumio Matsuoka; Naoji Ichise, all of Uji; Yasuhiro Yonezawa, Okazaki; Keiko Sakota, Uji, all of Japan

[73] Assignee: Unitika Ltd., Amagasaki, Japan

[21] Appl. No.: 604,532

[22] Filed: Feb. 20, 1996

[30] Foreign Application Priority Data

| | | | |
|---|---|---|---|
| Mar. 8, 1995 | [JP] | Japan | 7-047678 |
| Mar. 8, 1995 | [JP] | Japan | 7-047680 |
| Mar. 8, 1995 | [JP] | Japan | 7-047681 |
| Jul. 12, 1995 | [JP] | Japan | 7-175296 |

[51] Int. Cl.[6] ..... D04H 3/14; D04H 3/16

[52] U.S. Cl. ..... 428/198; 156/62.6; 156/308.4; 442/338; 442/362; 442/364; 442/365; 442/414; 428/373; 428/374; 428/376

[58] Field of Search ..... 428/198; 442/338, 442/414, 362, 364, 365; 156/62.6, 308.4

[56] References Cited

FOREIGN PATENT DOCUMENTS

| | | |
|---|---|---|
| 93318 | 4/1993 | Japan . |
| 218734 | 9/1994 | Japan . |
| 273344 | 11/1994 | Japan . |
| 10709 | 1/1995 | Japan . |

*Primary Examiner*—James C. Cannon

*Attorney, Agent, or Firm*—Barnes, Kisselle, Raisch, Choate, Whittemore & Hulbert, P.C.

[57] ABSTRACT

A biodegradable filament nonwoven fabric comprising a nonwoven web made up of filaments, each filament comprising a high melting point component composed of a first aliphatic polyester having biodegradability and a low melting point component composed of a second aliphatic polyester having biodegradability with a melting point lower than that of the high melting point component, the nonwoven web processed to a predetermined nonwoven fabric configuration. At least one of the high melting point component and the low melting point component is arranged in a plurality of divisions within the cross section of the filament. Both the high melting point component and the low melting point component extend continuously in the axial direction of the filament and are exposed on the surface of the filament. A method for manufacturing the biodegradable filament nonwoven fabric is also disclosed herein.

47 Claims, 3 Drawing Sheets

BIODEGRADABLE FILAMENT NONWOVEN FABRICS AND METHOD OF MANUFACTURING THE SAME

FIELD OF THE INVENTION

The present invention relates to biodegradable filament nonwoven fabrics for use in a wide range of applications, such as medical/sanitary materials, household materials, and industrial materials.

BACKGROUND OF THE INVENTION

Nonwoven fabrics comprised of thermoplastic polymers, such as polyethylene, polypropylene, polyester, and polyamide, are known as materials for use in the fabrication of medical/sanitary goods, general household and related goods, and some industrial supplies. Such nonwoven fabrics are not self-degradable because they are made from such polymers as aforesaid which are chemically stable under ordinary natural environmental conditions. Therefore, in disposable type end-uses, it has been a common practice that they, after use, are disposed of by incineration or landfilling. In the case of incineration disposal, considerable costs are required for and in connection with plant construction and installation of pollution control equipments, and yet the generation of waste gas is inevitable, which is a problem from the standpoint of natural and living environment protection. In the case of landfilling disposal, since the material is chemically stable in ordinary natural environmental conditions, there is a problem that the material will long remain intact in its original condition in the earth. In order to solve these problems, there have been developed various types of nonwoven fabrics comprised of biodegradable materials.

Currently known biodegradable nonwoven fabrics include, for example, viscose rayon staple nonwoven fabrics produced by the dry process or the solution immersion method, cuprammonium rayon filament nonwoven and viscose rayon filament nonwoven fabrics produced by the wet process, nonwoven fabrics produced from regenerated fibers of natural substances, such as chitin and collagen, and spun-laced nonwoven fabrics comprised of cotton fibers. However, these nonwoven fabrics have low mechanical strength and are hydrophilic, and are therefore subject to a substantial decrease in their mechanical strength when they have absorbed water or got wet. Another problem is that their respective materials are per se non-thermoplastic and, therefore, have no thermal adhesion property.

Biodegradable nonwoven fabrics intended to solve these problems are described in, for example, Japanese Patent Application Laid-Open Nos. 5-93318 and 5-195407. However, these biodegradable nonwoven fabrics are such that the constituent polymer has a low melting point and a low crystallizing temperature, and has poor quenching and filament forming properties while being spun into filaments. Therefore, the method for producing such nonwoven fabric is not practically applicable to the fabrication of a spunbonded nonwoven fabric. Furthermore, the polymer is of the full melting type, that is, becoming completely fluid at a melting point, and this has made it impracticable to provide a nonwoven fabric having high flexibility.

In the manufacture of a biodegradable filament nonwoven fabric, such problems do occur generally because the biodegradable polymer has a low melting point, and more particularly a low crystallizing temperature, and because the rate of crystallization of the biodegradable polymer is low. Thus, in steps following melt spinning, such as quenching, fine-drawing, collecting, and web-forming, there occurs inter-filamentary adhesion which prevents sufficient filament separation, so that the resulting nonwoven fabric is of a very poor texture formation and cannot fully exhibit such biological degradation capability as primarily expected of the non-woven fabric.

The cross sectional fiber configuration of filaments also involves a problem. Conventionally, there has been known a single phase type configuration of filaments such that the filament is comprised of one component only. However, in producing a nonwoven fabric from a single phase type filament by employing the spun bond process, if a biodegradable polymer having a relatively high melting point and a relatively high crystallizing temperature is used with emphasis placed on the quenching and filament-separating characteristics of filaments, the resulting nonwoven fabric has only poor biological degradation performance; and conversely if a biodegradable polymer having a relatively low melting point and a relatively low crystallizing temperature is used with emphasis on biodegradability, the filaments spun have insufficient quenching and filament-separating characteristics. In the current state of the art, it has been impossible to exercise any delicate control of spinning and fabric forming operations, though biodegradability control may possibly be effected to a minor extent by changing the type and fineness of the polymer used.

SUMMARY OF THE INVENTION

The present invention is directed to solving these problems. Accordingly, one object of the present invention is to provide a biodegradable nonwoven fabric which has good filament-quenching and filament-separating properties and is biodegradable in a controlled manner, and which has high mechanical characteristics, good texture formation, and thermal adhesion capability; and a further object is to present a method of manufacturing such a biodegradable nonwoven fabric.

In order to accomplish these objects, the invention provides a biodegradable filament nonwoven fabric comprising a nonwoven web made up of filaments, each filament consisting of a high melting point component composed of a first biodegradable aliphatic polyester and a low melting point component composed of a second biodegradable aliphatic polyester with a melting point lower than that of the first high melting point component, the nonwoven web processed to a predetermined nonwoven fabric form, at least, the said configuration specified with the high melting point component and the low melting point component being arranged in a plurality of divisions in a cross section of the composite filament, both the high melting point component and the low melting point component extending continuously in the axial direction of the said composite filament, the both components being exposed on the surface of the said composite filament.

DETAILED DESCRIPTION OF THE INVENTION

Filaments used in the present invention are composite filaments formed of two types of biodegradable aliphatic polyester components. In the invention, one of the components or a first aliphatic polyester which has a higher melting point is referred to as the high melting point component, and the other or a second aliphatic polyester which has lower melting point is referred to as the low melting point component.

Generally, the high melting point component has good filament quenching and filament-separating properties, but is less favorable in biodegradability because it has a relatively high degree of crystallinity. Conversely, the low melting point component is less favorable in respect of filament quenching and filament-separating properties, but has good biodegradability because its crystallinity is relatively low. For example, where the filament has a single-phase cross-sectional configuration consisting of a high melting point component only, the filament will not exhibit the desired biodegradability, though such cross-sectional configuration means good spinnability and ease of nonwoven fabric formation. While, where the filament has a single-phase cross-sectional configuration consisting of a low melting point component only, the filament has insufficient quenching characteristics and this makes it impracticable to obtain even a nonwoven fabric.

According to the invention, in a composite filament cross section, at least one of the high melting point component and the low melting point component is arranged in a plurality of divisions, and both the high melting point component and the low melting point component extend continuously in the axial direction of the filament and are exposed on the filament surface. Therefore, it is possible to finely divide the high melting point component which is less biodegradable but has good filament quenching and filament-separating properties, and also to finely divide the low melting point component which is less capable of filament quenching and filament separation but is highly biodegradable. In this way, it is possible to obtain a nonwoven fabric which has not only good filament quenching and filament-separating properties, but high biodegradability as well.

The constituent filaments of the nonwoven fabric in accordance with the invention preferably have a cross section belonging to one of the following three types, namely, alternate arrangement type composite section, annularly alternate arrangement type composite section, and multileaf type composite section.

The three types of filament cross sections preferred in the present invention will be described in detail hereinbelow.

Figure 1:
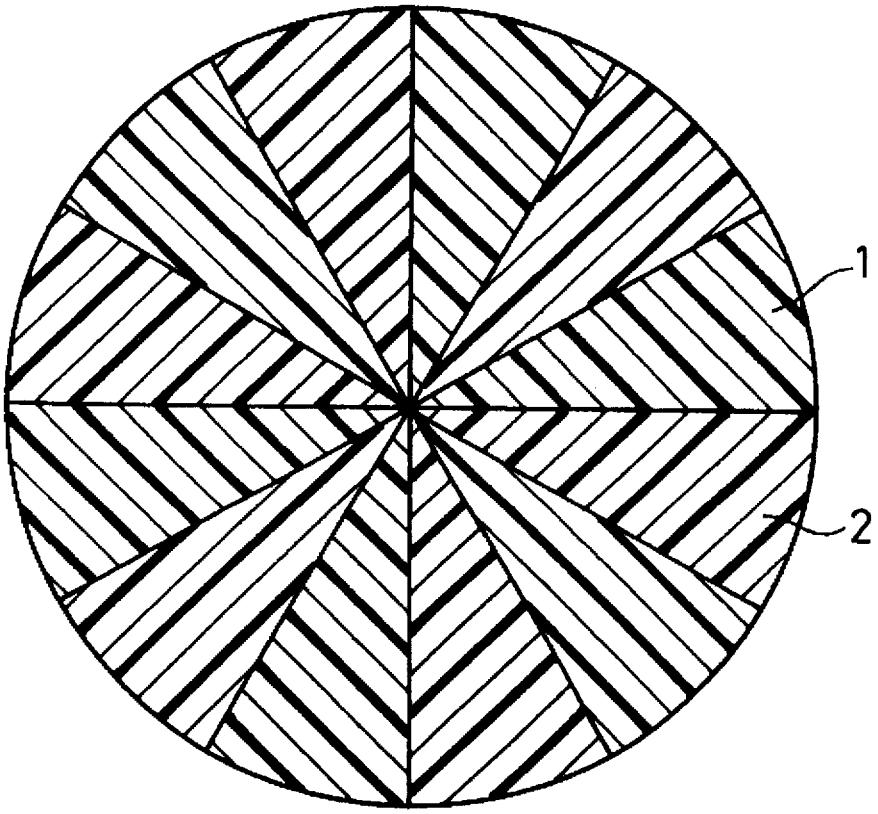
FIG. 1 is a model diagram of a filament cross section of an alternate arrangement type composite filament exemplary of a constituent filament of the present invention.

Referring first to FIG. 1, the alternate arrangement type composite section is shown as a filament cross section in which a high melting point component 1 and a low melting point component 2 occupy predetermined divisional areas at alternate intervals, each divisional area extending from the center of the filament section to the circumferential surface thereof, the high melting point component 1 and the low melting point component 2 being each arranged in equally divided condition, and in which both the high melting point component 1 and the low melting point component 2 extend continuously in the axial direction of the filament and are exposed on the surface of the filament. With such a sectional configuration, wherein the high melting point component 1 and the low melting point component 2 are alternately arranged, even if the low melting point component 2, for example, is a polymer having inferior quenching and filament-separating properties, adjacent divisions of high melting point component 2 provide for improvement in the quenching and filament-separating properties of filaments. Further, even if the high melting point component 1 is a polymer having poor biodegradability, adjacent divisions of the low melting point component 2 have good biodegradability and, therefore, as the low melting point component 2 is decomposed, divisions of the high melting point component 1 are left only in the form of very fine, thin wedge-like pieces. This tells that a nonwoven fabric comprised of such filaments is highly biodegradable. Furthermore, since the high melting point component 1 and the low melting point component 2 are each arranged in equally divided condition, the high melting point component 1 which has good filament quenching and filament-separating properties and the low melting point component 2 which is highly biodegradable are arranged in a well balanced condition on the filament surface. This enables the objective nonwoven fabric to have a well-balanced and uniform distribution of filament quenching and filament-separating properties and good biodegradation capability throughout the entirety of the nonwoven fabric. Additionally, it is essential that both the high melting point component 1 and the low melting point component 2 should extend continuously in the axial direction of the composite filament to enhance the stability of the filament cross section, spinnability, and mechanical characteristics of the filament. Also, it is necessary that both the high melting pointcomponent 1 and the low melting point component 2 be exposed on the filament surface to enhance the quenching and filament-separating characteristics of, and to enhance and control biodegradation capability of filaments.

Figure 2:
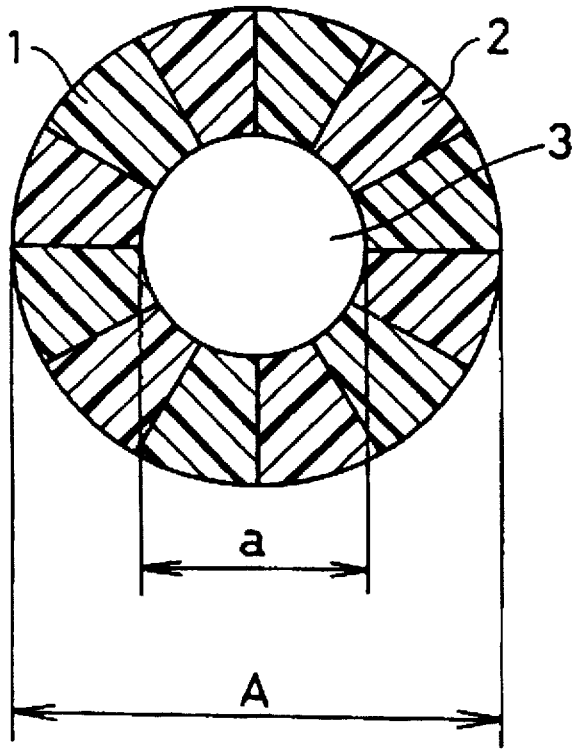
FIG. 2 is a model diagram of a filament cross section of an annularly alternate arrangement type composite filament representing another form of the constituent filament of the invention.

Referring second to FIG. 2, the annularly alternate arrangement type composite section is shown as a filament cross section wherein the filament has a hollow portion 3; wherein a high melting point component 1 and a low melting point component 2 occupy predetermined divisional areas at alternate intervals, each divisional area extending from the hollow portion 3 to the circumferential surface of the filament, the high melting point component 1 and the low melting point component 2 being each arranged in equally divided conformation, and wherein both the high melting point component 1 and the low melting point component 2 extend continuously in the axial direction of the filament and are exposed on the surface of the filament and to the hollow portion 3. This sectional configuration is identical with the first mentioned alternate arrangement type composite section except that the hollow portion 3 is provided. The provision of the hollow portion 3 in the cross section of the filament permits greater improvement in the quenching performance of filaments and a larger increase in the rate of biological degradation than the alternate arrangement type composite section does permit. That is, because of the presence of the hollow portion 3, as the decomposition of the low melting point component 2 progresses, divisions of the high melting point component 1 will undergo a quick change such that they are left only in the form of very thin arcuate pieces, with the result that biological degradation is accelerated. In this conjunction, it is essential that both the high melting point component 1 and the low melting point component 2 be exposed to the hollow portion 3 to enhance the quenching and filament-separating characteristics, and to enhance and control biodegradation performance of filaments. In case that the low melting point component 2 does not extend to the hollow portion 3 of the filament cross section, more time is required until the high melting point component 1 becomes arcuate in shape, with the result that the nonwoven fabric is less biodegradable.

Third, referring to FIGS. 3 to 5, the multileaf type composite section is shown as a filament cross section wherein the low melting point component 2 defines a center portion; wherein the high melting point component 1 consists of a plurality of independent projections (hereinafter referred to as "elements" in the multileaf type composite section) arranged along the circumferential edge of the low melting point component 2; and wherein both the high melting pointcomponent 1 and the low melting point component 2 extend continuously in the axial direction of the filament and are exposed on the filament surface. The fact that the high melting point component 1 defines a plurality of independent projections arranged along the circumferential edge of the low melting point component 2 which defines the center portion is necessary in order to permit good biodegradability to be well maintained. It is also required that both the high melting point component 1 and the low melting point component 2 should extend continuously in the axial direction of the filament in order to improve the stability of the filament cross section, spinnability, and mechanical characteristics of the filament. Further, it is necessary that both the high melting point component 1 and the low melting point component 2 be exposed on the filament surface in order to enhance quenching and filament-separating capabilities, and enhance and control biodegradability, of filaments. By using filaments having a composite sectional configuration of the multileaf type it is possible to improve the quenching and filament-separating properties of filaments even if the low melting point component 2, for example, is a polymer having inferior quenching and filament-separating properties, because inter-filamentary adhesion can be prevented by the high melting point component 1 which defines individual projections. Even if the high melting point component 1 is a polymer having poor biodegradability, the centrally located low melting point component 2 which has good biodegradability acts so that the high melting point component 1 will, in the course of time, be left only as small,pieces of extreme fineness. This tells that nonwoven fabrics made up of such filaments exhibit excellent biodegradation capability.

Aliphatic polyesters useful for forming a composite filament in the present invention include, for example, poly(α-hydroxy acid), such as poly(glycolic acid) or poly(lactic acid); poly(ω-hydroxyalkanoate), such as poly(ε-caprolactone) or poly(β-propiolactone); or poly (βhydroxyalkanoate), such as poly(3-hydroxypropionate), poly(3-hydroxybutylate), poly(3-hydroxycaproate), poly(3-hydroxyheptanoate), or poly(3-hydroxyoctanoate). Also, copolymers consisting of repeating units of any of the foregoing polymers may be exemplified as such. Other examples may include copolymers consisting of a repeating unit of any of the foregoing polymers and a repeating unit of poly(3-hydroxyvalerate) or poly(4-hydroxybutylate). Useful aliphatic polyesters comprised of condensation polymers of diol and dicarboxylic acid include, for example, poly (ethyleneoxalate), poly(ethylenesuccinate), poly (ethyleneadipate), poly(ethyleneazelate), poly (butyleneoxalate), poly(butylenesuccinate), poly (butyleneadipate), poly(butylenesebacate), and poly (neopentyloxalate); or copolymers of repeating units of these.

Of the foregoing aliphatic polyesters, poly (ethylenesuccinate), poly(butylenesuccinate), poly (butyleneadipate), poly(butylenesebacate), poly(lactic acid), or copolymers consisting of repeating units of these are advantageously used because they have a good filament forming property and good biodegradability.

In the present invention, an aliphatic polyester amide-based polymer, or a condensation polymer of: a repeating unit of any of the above enumerated aliphatic polyesters and a repeating unit of an aliphatic polyamide, such as poly (capronamide) (nylon 6), poly(tetramethylene adipamide) (nylon 46), poly(hexamethyleneadipamide) (nylon 66), poly (undecanamide) (nylon 11), or poly(lauric lactamide) (nylon 12), may be used, if it is biodegradable.

In filaments having an alternate arrangement type composite section or an annularly alternate arrangement type composite section, the high melting point component is preferably poly(butylenesuccinate), and the low melting point component is preferably a copolymerized polyester comprising butylenesuccinate as a main repeating unit in a proportion of from 70 to 90 mol % relative to the moles of total repeating units in the said low melting point component polymer. In filaments having a multileaf type composite section, both the high melting point component and the low melting point component are preferably a polymer comprising butylenesuccinate as a main repeating unit, the high melting point component being preferably a poly (butylenesuccinate) or a copolymerized polyester comprising butylenesuccinate in a proportion of 80 mol % or more relative to the moles of total repeating units in the said high melting point component polymer, the low melting point component being preferably a copolymerized polyester comprising butylenesuccinate in a proportion of from 70 to 90 mol % relative to the moles of total repeating units in the said low melting point component polymer. If the proportion of butylenesuccinate relative to said copolymer is excessively low, the copolymer has poor filament quenching and filament-separating characteristics, though it may have good biodegradability, and therefore it is impracticable to obtain the desired filament, which in turn makes it impracticable to obtain the desired nonwoven fabric. Conversely, if the proportion of butylenesuccinate relative to the said copolymer is too high, the copolymer may have good quenching and filament-separating characteristics, but has poor biodegradability, which is outside the object of the invention.

Where an aliphatic polyester comprised of a copolymer is used as a low melting point component for forming an alternate arrangement type composite section or annularly alternate arrangement type composite section, a copolymer polyester in which butylenesuccinate is copolymerized with ethylenesuccinate or butyleneadipate is preferred. Where an aliphatic polyester comprised of a copolymer is used as both high melting point and low melting pointcomponents or only as a low melting point component for forming a multileaf type composite section, a copolymer polyester in which butylenesuccinate is copolymerized with one of ethylenesuccinate, butylene-adipate and butylenesebacate is preferred.

Generally, in the case of materials of the same polymeric base, a copolymer is superior to a homopolymer in biodegradability, but is inferior in filament quenching and filament-separating properties, spinnability, and mechanical characteristics. This means that biodegradability on one hand and filament quenching property, etc. on the other can hardly be made consistent or synergistic with each other. In the present invention, it is essential to satisfy all the requirements including biodegradability, filament quenching property, and so forth, and to this end above described composite sectional configurations are applied to control the quenching property, spinnability, filament-separating property, mechanical characteristics and biodegradability of the filament.

In the invention, in order to control quenching property, spinnability, filament-separating property, mechanical characteristics, and biodegradability of the filament in a more delicate manner, it is preferable to use in blending two or more polymers selected from the group consisting of above enumerated homopolymers and copolymer polyesters, more particularly, poly(ethylenesuccinate), poly (butylenesuccinate), poly(butyleneadipate), poly (butylenesebacate), poly(lactic acid), and copolymer polyesters composed of repeating units of these. In particular, in the case of materials of the same polymeric base, it is preferable to use a homopolymer and a copolymer in blend.

In the present invention, where a blend is used, it is preferable that the blend ratio (wt %) of one polymer to be blended to the other be 10/90–90/10 in order to ensure good adhesion while making best use of respective characteristics of the two polymers. If either one is less than 10 wt %, the characteristics of the other polymer are substantially affected, and this makes it difficult to exercise delicate control with respect to the filament quenching property and spinnability, filament-separating property, mechanical characteristics, and biodegradability, of filaments produced. When using a blend, it is also preferable from the standpoint of spinnability that polymers having good miscibility be used in combination.

In the invention, the difference in melting points between the high melting point component and the low melting pointcomponent be preferably not less than 5° C., more preferably not less than 10° C. If the difference in melting points is less than 5° C., the cross section of the filament goes closer to the full-melting type as in the case of a single phase cross section. Therefore, in partial bonding with heat and pressure for nonwoven fabric making, some thermal damage may be caused not only to the low melting point component, but also to the high melting point component, and the resulting nonwoven fabric will not concurrently have good mechanical characteristics and good flexibility.

From the standpoint of spinnability, it is preferable that high melting point and low melting point components used in the invention be polymers having miscibility and chemical affinity with respect to each other.

With these facts in mind, for aliphatic polyesters used in the present invention, polymers based on poly(lactic acid) in particular may be advantageously used because they have a relatively high melting point. In this case, polymers selected from among poly(D-lactic acid), poly(L-lactic acid), and copolymers consisting of L-lactic acid and hydroxycarboxylic acid, but having a melting point of not less than 100° C., or blends of these polymers are preferred.

For the aliphatic polyesters applicable for the purpose of the invention, those having a number-average molecular weight of not less than 20,000, preferably of not less than 40,000, more preferably of not less than 60,000, are preferred from the standpoints of spinnability, and characteristics of filaments produced. Also, those which have been chain-lengthened with a small amount of diisocyanate, tetracarboxylic acid anhydride or the like for increasing the degree of polymerization may be used.

In filaments applicable for the purpose of the present invention, it is desirable that at least the low melting point component of the constituents of the filament should incorporate a crystallizing agent; and the high melting point component may also be loaded with such agent as required. The process of quenching and solidifying after melt spinning is accelerated by addition of a crystallizing agent and, therefore, even where the polymer is of low crystallinity, inter-filamentary adhesion can be effectively prevented. Addition of a crystallizing agent is effected in the polymerization stage or melting stage. In connection with this operation, in order to improve the mechanical characteristics and uniformity of resulting filaments, it is desirable that the crystallizing agent be dispersed as uniformly as practicable.

For the crystallizing agent, materials such as talc, calcium carbonate, titanium oxide, boron nitride, silica gel, and magnesium oxide are typically used without any particular limitation, provided that they are powdery inorganic substances and are not liable to become dissolved in a melt. Of these materials, talc or titanium oxide, or a mixture thereof, in particular, may be advantageously used.

Preferably, the mean particle size of such inorganic powder, as crystallizing agent, is not more than 5 μm. If the mean particle exceeds 5 μm, there may occur a tendency that makes it difficult to obtain filaments of finer denier, or clogging is likely to occur in a filter within a spinneret equipped with a plurality of orifices, with the result that spinning efficiency tends to decrease. For this reason, the mean particle size of inorganic powder as a crystallizing agent is not more than 5 μm, preferably not more than 4 μm, more preferably not more than 3 μm.

The bulk specific volume of any inorganic powder as crystallizing agent is preferably 2–10 cc/g, more preferably 3–8 cc/g. It is noted that the term "bulk specific volume" herein refers to the volume of inorganic powder per unit weight. The larger the bulk specific volume, the larger is the surface area of the inorganic powder, which means increased effect of the inorganic powder as a crystallizing agent. If the bulk specific volume of the inorganic powder is less than 2 cc/g, the effect of the inorganic powder as crystallizing agent is lowered, and this makes it necessary to increase the amount of addition of the crystallizing agent (content within the polymer), so that the resulting filament, which in turn means, nonwoven fabric, will have decreased mechanical strength. An inorganic powder having a bulk specific volume greater than 10 cc/g is difficult to produce, and any attempt to produce such inorganic powder may result in considerable increase in costs, which in turn will result in considerable increase in the production cost of filaments.

For addition of a crystallizing agent, it is necessary that assuming that where the crystallizing agent is added to the high melting point component, the amount of that addition is QA (wt %) ($0 \leqq QA$), and that the amount of the crystallizing agent added to the low melting point component is QB (wt %) ($0 < QB$), the crystallizing agent loadings must satisfy the following equations (1) and (2):

$$[(\Delta TA+\Delta TB)/100]-2/3 \leqq QA+QB \leqq [(\Delta TA+\Delta TB)/100]+4 \quad (1)$$

$$QA \leqq QB \quad (2)$$

where,

ΔTA=(melting point (°C.) of high melting point component)−(crystallizing temperature (°C.) of high melting point component)≧35;

$\Delta TB$=(melting point (°C.) of low melting point component)−(crystallizing temperature (°C.) of low melting point component)≧35.

If the total amount of crystallizing agent loadings QA+QB (wt %) exceeds the upper limit defined by equation (1), spinnability is unacceptably lowered and the resulting filaments and, in turn, nonwoven fabric may have inferior mechanical performance, whereas filaments may exhibit high quenching efficiency. Conversely, if the total amount of crystallizing agent loadings QA+QB is smaller than the lower limit defined by equation (1), quenching efficiency of filaments is lowered to give rise to inter-filamentary adhesion, it being thus impracticable to obtain a target nonwoven fabric. If the crystallizing agent loadings QA (wt %) in the high melting point component exceed the crystallizing agent loadings QB (wt %) in the low melting point component, the quenching efficiency of the high melting point component may be further improved, but the quenching efficiency of the low melting point component may become unacceptably low, with the result that inter-filamentary adhesion is more likely to occur.

In equation (1), $\Delta T$ is the difference between the melting point of each component and the crystallizing temperature of each component. In the spinning process, the smaller the $\Delta T$, the larger is the quenching efficiency of filaments. In the polymers used in the present invention, $\Delta T$ is usually larger than 35, but it may be well appreciated that filament quenching can be effectively enhanced through addition of a crystallizing agent.

Aliphatic polyesters used in the invention may, as required, be loaded with various additives such as, delustering agent, pigment, light stabilizer, weathering agent, and antioxidant, within the limits acceptable in the light of the effects of the present invention.

For purposes of using the alternate arrangement type and annularly alternate arrangement type composite sectional configurations, the number of elements for each of the high melting point component 1 and the low melting point component 2 is preferably 3 to 20. The term "number of elements" herein means the number of smallest units of the high melting point component 1 or the low melting point component 2 which are arranged in separated condition in a cross section of the filament. If the number of such elements of each component is less than 3, the quenching and filament-separating efficiencies of filaments will be unacceptably poor, and filament biodegradability will be also unacceptably poor. If the number of such elements is more than 20, the number of orifices at the spinneret is insufficient, which means lower productivity and unstable composite sectional configuration. Therefore, if the low melting point component 2 is a polymer having unsatisfactory filament quenching and filament-separating characteristics and if the number of elements is less than 3, it is difficult to improve the quenching and filament-separating characteristics, because each element is too large to permit such improvement. Where the high melting point component 1 is a polymer having poor biodegradability, the high melting point component 1 may be finely divided by increasing the number of elements, whereby the biodegradability of the polymer can be enhanced. Therefore, the number of elements of each component is more preferably 6 to 18.

Where alternate arrangement type and annularly alternate arrangement type composite sectional configurations are utilized, it is preferable that individual elements representing divided portions of the high melting point component 1 and low melting point component 2 have a fineness of from 0.05 to 1.0 denier. If the fineness of each element is less than 0.05 denier, production will be lowered and the cross-sectional configuration of filaments will become unstable. If the fineness of each element is more than 1.0 denier, the result will be poor filament quenching and filament-separating characteristics and inferior biodegradability. If the high melting point component 1 is a polymer having poor biodegradability, the rate of biological degradation can be increased by using finer denier elements. Therefore, the fineness of individual elements is more preferably from 0.1 to 0.8 denier.

Where the annular alternate arrangement type of composite section is utilized, a hollowness ratio of 5–30% is preferred. The term "hollowness ratio" herein means a value given by the following equation wherein, as FIG. 2 shows, the filament diameter in the cross section of the filament is designated by (A), and the diameter of the hollow portion 3 is designated by (a):

Hollowness ratio (%)=$(a^2/A^2)\times 100$

A hollowness ratio of less than 5% is insufficient for enhancing the quenching efficiency and biodegradability of filaments. A hollowness ratio of more than 30% is also undesirable because it may be a cause of puncture trouble with the hollow portion 3 in the spinning stage, which will seriously hinder high-speed spinning operation. Therefore, the hollowness ratio is more preferably 18–25%.

Where the multileaf type of composite section is adopted, the number of projections of the high melting point component 1 is preferably 4–10. If the number of projections of the high melting point component 1 is less than 4, the quenching and filament-separating efficiencies and biodegradability of filaments will be unacceptably poor. In the present invention, the larger the radially outwardly oriented proportion of the high melting point component 1, the better is the quenching and filament-separating efficiencies of filaments. If the number of projections is less than 4, the circumferential occupancy ratio of the low melting point component 2 is excessively large, resulting in insufficiency of filament quenching and filament-separating efficiencies. In order to avoid such a drawback, one may attempt to increase the compound ratio of the high melting point component 1. However, this means that independent projections of the high melting point component 1, or smallest constituent units of the high melting point component 1 in the cross section of the filament, tend to become coarser, it being thus inevitable that the resulting nonwoven fabric should be unsatisfactory in respect of biodegradability. If the number of projections of the high melting point component 1 is more than 10, it is impracticable to allow the elements of the high melting point component 1 to be arranged as individually independent units. This prevents low melting point component elements to be exposed on the filament surface, which is undesirable from the standpoint of biodegradability. For these reasons, the number of projections of the high melting point component 1 is more preferably from 5 to 10.

When using the multileaf type of composite filament cross section, it is desirable that element fineness of the high melting point component 1 should be from 0.05 to 2 denier. The term "element fineness" of the high melting point component 1 means the fineness of each constituent unit of the high melting point component 1 in the cross section of the filament. If the element fineness of the high melting point component 1 is less than 0.05 denier, productivity is lowered and cross-sectional filament configuration is rendered unstable. If the element fineness of the high melting point component 1 exceeds 2 denier, unsatisfactory quenching and filament-separating efficiencies, and also poor biodegradability will result. For these reasons, the element fineness of the high melting point component 1 is more preferably 0.1 to 1 denier.

Where the multileaf type of composite section is used, the perimeter ratio of high melting point component/low melting point component, that is, the ratio between circumferential lengths occupied by respective components about the perimeter of the filament cross section, is preferably high melting point component/low melting point component=90/10–40/60. If, for example, the perimeter occupancy ratio of the high melting point component 1 in the filament cross section becomes larger, projections of the high melting point component 1 will grow larger accordingly. While, the perimeter occupancy ratio of the low melting point component 2 is too small to permit web boding with heat and pressure to be satisfactorily effected. Therefore, the resulting nonwoven web would be one having poor mechanical performance. Moreover, as independent elements of the high melting point component 1 become coarser, the resulting nonwoven fabric tends to be of lower biodegradability. If the perimeter occupancy ratio of the low melting point component 2 becomes larger, the quenching efficiency of filaments tends to decrease, with the result that melt adhesion troubles are likely to occur in the process of drawing and filament-separating.

For purposes of using the multileaf type of composite section, there is no particular limitation as to the manner in which independent elements of the high melting point component 1 are arranged, but it is preferable that individual elements of the high melting point component 1 are located in equally spaced relation on the perimeter of the filament cross section. If individual elements are located in offset relation on the perimeter of the filament cross section, filament kneeling is likely to occur in the spinning stage, and in the process of web bonding with heat and pressure, interlocking of filaments may be hindered so that points of adhesion contact between high melting point component 1 and low melting point component 2 may not be uniformly given, which will likely cause unevenness in the strength characteristic of nonwoven fabrics produced. Further, it is preferable that individual elements of the high melting point component 1 be so arranged as to be buried in the low melting point component 2 in even proportions. Where individual elements of the high melting point component 1 are buried in the low melting point component 2 in different proportions, during web bonding with heat and pressure, some difficulty may be encountered in causing filaments to become interlocked so that contact points of adhesion between high melting point component 1 and low melting point component 2 may not be uniformly given, it being therefore likely that the resulting nonwoven fabric will have no strength uniformity. The manner and proportions in which elements of the high melting point component 1 should be arranged so as to be buried in the low melting point component 2 may be suitably selected as desired. The range for such selection includes, for example, cases shown in FIGS. 4 and 5. In the FIG. 4 case, elements of the high melting point component 1 are arranged in such a way that center B of each element is located outside the perimeter of the low melting point component 2, in which case the perimeter occupancy ratio of the high melting point component 1 is larger. In the FIG. 5 case, elements of the high melting point component 1 are arranged in such a way that center B of each element is located inside the perimeter of the low melting point component 2, in which case the perimeter occupancy ratio of the low melting point component 2 is larger. It is to be noted in the above connection that each element of the high melting point component 1 should at least partially overlap with the low melting point component 2 so as not to be separated from the latter during spinning and fabric forming operations, and that the low melting point component 2 is not bifurcated by the high melting point component 1 which is buried in the former. For the convenience of filament interlocking during the process of web bonding with heat and pressure, the pattern of arrangement as shown in FIG. 3 is preferred in which the center B of each element of the high melting point component 1 is located on the perimeter of the low melting point component 2.

The fineness of a single composite filament applicable to the present invention is preferably 1.5 to 10 denier. The fineness of less than 1.5 denier is undesirable because it involves increased complicatedness of spinneret, increased filament breakage in the spinning stage, decreased production, and lack of configurational stability with respect to filament cross section. The fineness of more than 10 denier is also undesirable because it involves poor filament quenching efficiency and inferior biodegradability. More preferably, therefore, the fineness of the single filament applicable is 2–8 denier.

The weight per unit area of the nonwoven fabrics in the present invention may be suitably selected, preferably from a range of from 10 to 150 g/m$^2$, more preferably from a range of from 15 to 70 g/m$^2$. The weight of less than 10 g/m$^2$ may provide for good flexibility and higher rate of biological degradation, but does not suit practical purposes because the fabric is of low mechanical strength. The weight of more than 150 g/m$^2$ means a fabric having hard feel and is undesirable in applications such as medical and sanitary supplies, wiping cloth and other general household materials, in which soft hand is required in particular.

The biodegradable filament nonwoven fabrics in accordance with the present invention are preferably such that constituent filaments of the nonwoven web are partially bonded with heat and pressure to the predetermined nonwoven fabric configuration. More particularly, where the alternate arrangement type of composite filament or the annularly alternate arrangement type of composite filament is used, mainly constituents of the low melting point component 2 are bonded together with heat and pressure, and where the multileaf type of composite filament is used, the low melting point component 2 which is softened mainly by heating and the high melting point component 1 which defines projections are bonded with heat and pressure. In either case, constituents of the high melting point component 1 are not bonded together with heat and pressure, and this is important for provision of biodegradability and good flexibility.

Where the nonwoven web is processed into a nonwoven fabric by partial bonding with heat and pressure, the ratio of the bonded area, or the ratio of the total bonded area with heat and pressure to the total surface area of the nonwoven web, should be 2–30%, preferably 4–20%. If the bonded area ratio is less than 2%, there will be no improvement in the dimensional stability of the nonwoven web after bonding with heat and pressure, which means inferior dimensional stability of the resulting nonwoven fabric. If the bonded area ratio is more than 30%, the resulting nonwoven fabric has only poor flexibility and insufficient bulkiness, and is less biodegradable.

As described above, the present invention provides nonwoven fabrics made up of composite filaments of the alternate arrangement type, annularly alternate arrangement type, or multileaf type, each filament comprised of high melting point component 1 and low melting point component 2 which have different degrees of biological degradation capability. By suitably adapting aforesaid factors, such as compound ratio of the two components, respective element numbers of the components, element fineness, and single filament fineness, it is possible to properly control the required filament quenching and filament-separating efficiencies, and biodegradability.

Next, the method of manufacturing such biodegradable filament nonwoven fabric according to the invention will be described.

The manufacture of biodegradable filament nonwoven fabrics of the invention may be carried out by employing conventional composite spinning equipment. More specifically, first, polymers to be used as high melting point component and low melting point component suitably selected from among the earlier enumerated aliphatic polyesters and the same are separately melted, and the melts are separately metered; then the melts are caused to be discharged through a composite spinning spinneret which is capable of formation of, preferably, above described alternate arrangement type composite section, or annularly alternate arrangement type composite section, or multileaf type composite section. Then, the filaments spun are quenched by a conventional quenching apparatus, and the quenched filaments are drafted and attenuated by a conventional take-up apparatus, such as air sucker, to a target fineness before they are collected. The drafted and attenuated composite filaments are filament-separated by a conventional device, and the filament-separated composite filaments are then deposited in filament-separated condition on a moving collector surface such as a screen conveyor, thus being formed into a nonwoven web. Subsequently, the nonwoven web is converted into a nonwoven fabric of a predetermined configuration by a conventional method. A biodegradable filament nonwoven fabric has now been obtained.

In the present invention, as above stated, from the view points of filament quenching and filament-separating efficiencies and spinnability, it is desirable that the filament cross section be a composite section of the alternate arrangement type, or annularly alternate arrangement type, or multileaf type. For this purpose, depending on the type of the composite section, it is desirable to suitably select such composite spinning spinneret, discharged amount, and drawing rate as will enable a filament cross-sectional configuration to be formed which can satisfy above described requirements with respect to element number, element fineness, hollowness ratio, and single filament fineness. For use of materials, above enumerated aliphatic polyesters are preferred.

In the present invention, as earlier stated, it is preferable to load a crystallizing agent into the polymer which is to constitute at least the low melting point component of the filament. In this conjunction, it is desirable that the quantity of addition of the crystallizing agent is within the earlier stated range. That is, the quantity of such addition may be determined so that total loadings QA and QB (wt %) will satisfy the foregoing equation (1) and so that crystallizing agent loadings QA and QB (wt %) into respective components will satisfy the foregoing equation (2).

In the present invention, where filaments used are alternate arrangement type composite filaments or annularly alternate arrangement type composite filaments, the melt flow rate of the polymer (hereinafter referred to as MFR value) is preferably such that the MFR value for the high melting point component 1 is 20–70 g/10 min. and that for the low melting point component 2 is 15—50 g/10 min. It is noted that the term "MFR values" herein values measured according to the method described in ASTM-D-1238 (E). If the MFR value is lower than aforesaid range, or the component is of excessively high viscosity, drafting and attenuating of filaments cannot be smoothly carried out and operational performance will be unfavorably affected; furthermore, the resulting filaments are of coarse denier and lack inter-filamentary uniformity. If the MFR value is higher than aforesaid range, or the component is of excessively low viscosity, the composite section is unstable and there will occur filament breakage in the spinning stage, so that operational performance will be unfavorably affected; thus the resulting nonwoven fabric is of poor mechanical characteristics. Therefore, the MFR value of the high melting point component 1 is more preferably 25–65 g/10 min., and the MFR value of the low melting point component 2 is more preferably 18–45 g/10 min. In this conjunction, the viscosity of the high melting point component 1 is preferably lower than that of the low melting point component 2. Generally, in composite spinning of thermoplastic resin, filaments being spun have a cross-sectional aspect such that a low melting point component tends to cover a high melting point component. In the present invention, by arranging that the high melting point component 1 which is less biodegradable but has higher filament quenching efficiency is of lower viscosity, it is intended that the exposed proportion of the low melting point component 2 on the filament surface is reduced so that inter-filamentary adhesion contact is prevented, improved filament filament-separating efficiency being thus obtained. However, if the viscosity of the high melting point component 1 is extremely low, the high melting point component 1 will, in effect, cover the greater part of the low melting point component 2. This may reduce the trouble of adhesion contact and enhance the filament filament-separating efficiency, but will result in poor biodegradability. Needless to say, this is not what is intended by the invention.

Where the filament used is a multileaf type composite filament, the MFR values of polymers used are preferably such that with respect to both the high melting point component 1 and the low melting point component 2, MFR value is 1–100 g/10 min. Further, it is preferable that the MFR value of the high melting point component 1 is 15–50 g/10 min. and the MFR value of the low melting point component 2 is 20–70 g/10 min. If MFR value is lower than the foregoing range, which means that the viscosity is extremely high, fine drawing of filaments cannot be smoothly carried out and operational performance will be adversely affected. The resulting filaments are rather coarse and lack uniformity. If MFR value is higher than the foregoing range, which means that the viscosity is extremely low, the composite section is unstable and there will occur filament breakage in the spinning stage, so that operational performance will be unfavorably affected; thus the resulting nonwoven fabric is of poor mechanical characteristics. Therefore, the MFR value of the high melting point component 1 is more preferably 12–45 g/10 min., and the MFR value of the low melting point component 2 is more preferably 18–65 g/10 min. In this conjunction, it is preferable that the viscosity of the high melting point component 1 is higher than that of the low melting point component 2. One reason for this is that where the high melting point component 1 is of higher viscosity, elements of the high melting point component 1 can be separated to each other along the perimeter of the cross section of the filament.

In the present invention, it is desirable that melted materials be separately weighed so that the compound ratio of high melting point component/low melting point component may come within the range of from 1/3 to 3/1 in weight ratio. If the compound ratio deviates from the foregoing range, it is difficult to meet all of the characteristic requirements including filament quenching and filament-separating performance and biodegradability. Further, such deviation may easily invite lack of stability in filament cross sectional configuration. For example, if the compound ratio of high melting point component/low melting point component exceeds 1/3, high biodegradability can be achieved, but the filament quenching and filament-separating efficiencies will be lowered. Conversely, if the compound ratio exceeds 3/1, good filament quenching and filament-separating efficiencies can be achieved, but poor biodegradability will result. Further, if the high melting point component 1 is a polymer having poor biodegradability, the biological degradation performance can be enhanced by increasing the compound ratio of the low melting point component 2. Therefore, a compound ratio of from 1/2 to 2/1 in weight ratio is more preferable.

In the manufacturing method of the invention, spinning temperatures applicable during spinning operation may be varied depending on the polymer used, but may be suitably set in consideration of at least the MFR value of the polymer and the filamentation performance or spinnability of the polymer. Usually, the spinning temperature is set at least 40° C. higher than the melting point of the polymer, or preferably at 120°–300° C. in particular. A spinning temperature of less than 120° C. is undesirable because such a low spinning temperature makes it difficult to extrude the polymer due to the generation of unmelted polymeric matter and/or the viscosity of the melt being excessively high. A spinning temperature of more than 300° C. is also undesirable because it may cause heat deterioration to the polymer and/or slow down the process of filament quenching and solidification, which makes it impracticable to prevent interfilamentary adhesion even if a crystallizing agent is added to promote filament quenching and solidification.

For fine drawing in the present invention, it is preferable to use a drawing velocity of not less than 2000 m/min. More particularly, a drawing velocity of 2500 m/min. or more is preferred because it will enhance the dimensional stability of the nonwoven fabric. If the drawing velocity is less than 2000 m/min., it will not permit sufficient development of molecular orientation and, therefore, it is impracticable to obtain a nonwoven fabric having improved mechanical performance and dimensional stability.

In the present invention, for converting nonwoven webs into nonwoven fabrics, bonding techniques, such as a method for overall bonding with heat and pressure and a method for partial bonding with heat and pressure, and interlacing techniques, such as needle punch methods and pressure jet methods, may be employed. In particular, partial bonding methods with heat and pressure may be advantageously employed from the view points of biodegradability and flexibility of the resulting nonwoven fabric.

For partial bonding with heat and pressure, the following methods may be mentioned specifically for use: a method in which a heated embossing roll and a smooth-surfaced metallic roll are used to form dotted fusion bond areas between filaments; and a method in which a pin-sonic precessing apparatus by means of ultrasonic wave is used to apply ultrasonic high frequency on a pattern roll so as to form dot-like fusion bond areas between filaments on a pattern portion of the pattern roll. More specifically, the term "partial bonding" refers to bonding with heat and pressure applied to specific areas of the total surface area of the nonwoven web, such that individual bonded areas with heat and pressure may be of any particular shape, such as circular, elliptic, diamond, triangular, T-shaped, or intersecting parallels, and have an area of from 0.1 to 1.0 $mm^2$, and wherein such bond is effected at a density of 2–80 dots/$cm^2$, preferably 4–60 dots/$cm^2$. If the dot density is less than 2 dots/$cm^2$, the bonding with heat and pressure does not provide any improvement in the mechanical performance and shape retention characteristic of the web. If the dot density is more than 80 dots/$cm^2$, there is no improvement in flexibility and bulkiness. The compression-bonded area ratio of the web is 2–30%, preferably 4–20% as earlier stated.

In the case that a heated embossing roll is employed, bonding operation is carried out preferably within a processing temperature range of from (Tm −25)°C. to (Tm)°C., where (Tm)°C. is the melting point of the low melting point component 2. If the processing temperature is less than (Tm −25)°C. , the resulting nonwoven fabric has inferior mechanical performance and poor fuzz resistance. If the processing temperature is more than (Tm)°C., the polymer tends to be fixed to the apparatus for bonding with heat and pressure, adversely affecting the operational performance of the apparatus. Furthermore, the resulting nonwoven fabric has hard texture or hand, it being thus impracticable to obtain a flexible nonwoven fabric.

In the present invention, for the purpose of ultrasonic fusion bonding, an apparatus is employed which comprises an ultrasonic oscillator having a frequency of about 20 kHz, generally called horn, and a pattern roll having dot-shaped or band-like raised projections arranged on the periphery thereof. The pattern roll is disposed below the ultrasonic oscillator, and a nonwoven web is passed between the ultrasonic oscillator and the pattern roll, whereby the nonwoven web is partially bonded with heat and pressure. The raised projections provided on the pattern roll may be either in a single row or in a plurality of rows, and where they are provided in plural rows, the raised projections may be either in parallel rows or in staggered rows.

In the present invention, the process of partial bonding with heat and pressure wherein an embossing roll or an ultrasonic fusion bonding apparatus is employed may be carried out either in continuous operation or as a separate operation. Partial bonding with heat and pressure may be carried out by using either the embossing roll or the ultrasonic fusion bonding apparatus. Depending upon the end use for which the nonwoven fabric is used, and especially for medical and sanitary materials and general and domestic supplies, such as wiping cloths, of which is required softness, it is possible to provide nonwoven fabrics having good performance characteristics by employing the pin-sonic processing apparatus by means of ultrasonic wave.

According to the present invention, it is possible to provide biodegradable filament nonwoven fabrics having good texture and uniformity of the appearance, controllable biodegradability, and which exhibit good mechanical characteristics, good filament quenching and filament-separating efficiencies, good spinnability, and thermal adhesion capability, and a method of manufacturing such fabrics.

Nonwoven fabrics in accordance with the invention are suitable for use in various applications, including: medical and sanitary materials, such as diapers, menstrual supplies; disposable items, such as disposable wet hand towel, wiping cloth, and disposable packing materials; living-related materials, such as domestic/business food waste collecting sacks and other items for waste disposal; and industrial materials, typically agricultural, gardening and construction-related materials. The nonwoven fabrics, after use, can be completely degraded and destroyed, and are therefore very useful from the standpoint of natural environmental protection. Further, they may be recycled by being composted for use as fertilizer and are therefore very useful from the standpoint of resource reutilization as well.

DESCRIPTION OF EXAMPLES

The invention will now be explained more specifically with reference to the following Examples. It is understood, however, that the invention is not limited by these Examples.

In the Examples, measurements of various properties were carried out in accordance with the following methods.

Melt flow rate of biodegradable polymer (g/10 min.): Measured at 230° C. in accordance with the method described in ASTM-D-1238 (E)(hereinafter called "MFR value").

Melt flow rate of polypropylene(g/10 min.): Measured at 190° C. in accordance with the method described in ASTM-D-1238 (L)(hereinafter called "MFR value").

Inherent viscosity of polyethyleneterephthalate: Measured in a mixture solvent of phenol/tetrachloroethane=1/1 in weight ratio at the temperature of 20° C. according to conventional method.

Melting point (°C.): Based on a fusion/endotherm curve obtained from measurements conducted with a sample of 5 mg in weight, employing a differential scanning calorimeter, model DSC-2, made by Perkin Elmer, at the heating rate of 20° C./min, wherein the temperature which gave a maximal value was taken as melting point (°C.).

Crystallizing temperature (°C.): Based on a cure/exotherm curve obtained from measurements conducted with a sample of 5 mg in weight, employing a differential scanning calorimeter, model DSC-2, made by Perkin Elmer, at the cooling rate of 20° C./min, wherein the temperature which gave a maximal value was taken as crystallizing temperature (°C.).

Hollowness ratio(%): From a cross-sectional filament photograph taken by using a light microscope, made by Nikon, were found a filament diameter (A) and a hollow portion 3 diameter (a), as shown in FIG. 2. The hollowness ratio of the hollow portion 3 was calculated from the following relation:

Hollowness ratio (%)=$(a^2/A^2)\times 100$

Quenching efficiency: Filaments were visually evaluated under the following four-grade scheme:

○: Completely free from adhered filament.

○: No adhered filament found.

Δ: Adhered filaments found, though rather a few.

X: Most filaments adhering, filament-separating impossible.

Filament-separating efficiency: Nonwoven webs formed from filaments discharged from a filament filament-separating device were visually evaluated under the following three-grade scheme:

○: Most filaments separated, filaments not found in adhesion or gathering state.

Δ: Adhered filaments and gathering filaments found, though small in number.

X: Most filaments adhering, filament-separating effect inferior.

Weight per unit area (g/m$^2$): After ten specimens, each of 10 cm in length and 10 cm in width, prepared from samples in standard condition, were equilibrated in moisture regain, their weights (g) were averaged, and the average value was converted into a weight value per unit area to give weight per unit area (g/m$^2$).

Strength of nonwoven fabric (kg/5 cm width): Measured in accordance with the method described in JIS-L-1096A. Ten specimens of 20 cm in length and 5 cm in width were prepared. Each specimen was stretched lengthwise by Constant-Rate-of-Extension Tensile Testing Machine ("Tensiron" UTM-4-1-100, Toyo Bawldwin) at a extending rate of 10 cm/min. The average of breaking load values obtained was taken as strength (kg/5 cm width).

Softness of nonwoven fabric (g): Five specimens of 10 cm in length and 5 cm in width were prepared. Each specimen was laterally bent into a cylindrical shape, with both ends joined together, which was used as a softness testing piece. Each test piece was axially compressed by Constant-Rate-of-Extension Tensile Testing Machine ("Tensiron" UTM-4-1-100, Toyo Bawldwin) at a compression rate of 5 cm/min. The average of maximum load values (g) obtained was taken as softness (g). The smaller the softness value, the better is the softness feature.

Biodegradability: Nonwoven fabrics were buried in the earth and they were taken out 6 months later for examination. Where the nonwoven fabric was found as having lost its original configuration, or if its original shape was retained, the strength of the fabric had been lowered to less than 50% of its original value, the fabric was rated satisfactory (○) in biodegradability. Where the strength was found to be more than 50% of the initial strength held prior to burial in the earth, the biodegradability of the fabric was evaluated to be unsatisfactory (x).

Manufacture of Nonwoven Fabrics Using Alternate Arrangement Type Composite Filaments

EXAMPLE 1

A nonwoven fabric comprised of alternate arrangement type composite filaments was produced using, as high melting point component (hereinafter called "HMP component"), a poly(butylenesuccinate) having an MFR value of 40 g/10 min., a melting point of 114° C., and a crystallizing temperature of 75° C., and as low melting point component (hereinafter called "LMP component"), a copolymer polyester of butylene succinate/ethylene succinate=85/15 (mol %) having an MFR value of 30 g/10 min., a melting point of 102° C., and a crystallizing temperature of 52° C.

The two components were separately weighed so as to give a high melting point component/low melting point component compound ratio of 1/1 in weight ratio, and then they were melted at 180° C. by employing separate extruders. The melts were spun into alternate arrangement type composite filaments through a spinneret adapted to provide a cross-sectional filament configuration (in which elements of the two components are 6 each in number) as shown in FIG. 1, at a mass out flow rate from each orifice of 2.0 g/min. The filaments were quenched by a conventional quenching device, and were then drafted and attenuated and taken up at a drafting speed of 4500 m/min. by means of an air sucker disposed beneath the spinneret. Then, filaments were subjected to filament separation by a conventional filament-separating device and were filament-separated and laid up onto a moving screen conveyor so as to be formed into a nonwoven web comprised of composite filaments having a single filament fineness of 4.0 denier (fineness of high melting point component element=0.33 denier; fineness of low melting point component element=0.33 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out in such a way that an embossing roll having an engraved pattern area of 0.6 $mm^2$, with a compression dot density of 20 dots/$cm^2$ and a compression contact area ratio of 15%, and a metal roll having a smooth surface, were employed, with the operating temperature set at 95° C. Operational performance, nonwoven fabric properties, and biological degradation performance are shown in Table 1.

EXAMPLE 2

Alternate arrangement type composite filaments were melt spun under the same conditions as in EXAMPLE 1, except that a copolymer polyester of butylenesuccinate/butyleneadipate=80/20 (mol %) having an MFR value of 25 g/10 min., a melting point of 105° C., and a crystallizing temperature of 29° C. was used as low melting point component, and that the compound ratio of high melting point component low melting point component was 3/1 in weight ratio. The filaments were quenched by a conventional quenching device, and then were drafted and attenuated and taken up by an air sucker at a drafting speed of 4400 m/min. Then, filaments were subjected to filament separation by a conventional filament-separating device and were filament-separated and laid up onto a moving screen conveyor so as to be formed into a nonwoven web comprised of composite filaments having a single filament fineness of 4.1 denier (fineness of high melting point component element=0.51 denier; fineness of low melting point component element=0.17 denier). The nonwoven web was subjected to bonding with heat and pressure by a bonding device with heat and pressure comprising an embossing roll, and a biodegradable filament nonwoven fabric having a weight per unit area of 30 g/$m^2$ was obtained. Bonding with heat and pressure was carried out under the same conditions as in EXAMPLE 1 except that operating temperature was set at 98° C. Operational performance, nonwoven fabric properties, and biological degradation performance are shown in Table 1.

EXAMPLE 3

Alternate arrangement type composite filaments were melt spun under the same conditions as in EXAMPLE 1, except that a copolymer polyester of butylenesuccinate/ethylenesuccinate=70/30 (mol %) having an MFR value of 30 g/10 min., a melting point of 82° C., and a crystallizing temperature of 25° C. was used as low melting point component. The filaments were quenched by a conventional quenching device, and then were drafted and attenuated and taken up by an air sucker at a drafting speed of 4000 m/min. Then, filaments were subjected to filament separation by a conventional filament-separating device and were filament-separated and laid up onto a moving screen conveyor so as to be formed into a nonwoven web comprised of composite filaments having a single filament fineness of 4.5 denier (fineness of high melting point component element=0.38 denier; fineness of low melting point component element=0.38 denier). The nonwoven web was subjected to bonding with heat and pressure by a bonding device with heat and pressure comprising an embossing roll, and a biodegradable filament nonwoven fabric having a weight per unit area of 30 g/$m^2$ was obtained. Bonding with heat and pressure was carried out under the same conditions as in EXAMPLE 1 except that operating temperature was set at 75° C. Operational performance, nonwoven fabric properties, and biological degradation performance are shown in Table 1.

EXAMPLE 4

Alternate arrangement type composite filaments were melt spun under the same conditions as in EXAMPLE 1, except that a copolymer polyester of butylenesuccinate/ethylenesuccinate=90/10 (mol %) having an MFR value of 30 g/10 min., a melting point of 106° C., and a crystallizing temperature of 58° C. was used as low melting point component. The filaments were quenched by a conventional quenching device, and then were drafted and attenuated and taken up by an air sucker at a drafting speed of 4600 m/min. Then, filaments were subjected to filament separation by a conventional filament-separating device and were filament-separated and laid up onto a moving screen conveyor so as to be formed into a nonwoven web comprised of composite filaments having a single filament fineness of 3.9 denier (fineness of high melting point component element=0.33 denier; fineness of low melting point component element=0.33 denier). The nonwoven web was subjected to bonding with heat and pressure by a bonding device with heat and pressure comprising an embossing roll, and a biodegradable filament nonwoven fabric having a weight per unit area of 30 g/$m^2$ was obtained. Bonding with heat and pressure was carried out under the same conditions as in EXAMPLE 1 except that operating temperature was set at 99° C. Operational performance, nonwoven fabric properties, and biological degradation performance are shown in Table 1.

EXAMPLE 5

A nonwoven fabric comprised of alternate arrangement type composite filaments was produced using, as component A, a blend comprising 80 wt % of a poly(butylenesuccinate) identical with the high melting point component used in EXAMPLE 1 and 20 wt % of a copolymer polyester of butylenesuccinate/ethylenesuccinate=85/15 (mol %) identical with the low melting point component used in EXAMPLE 1 and, as component B, a copolymer polyester of butylenesuccinate/ethylenesuccinate=85/15 (mol %) identical with the low melting point component used in EXAMPLE 1.

The components A and B were separately weighed so as to give a compound ratio of 1/1 in weight ratio for component A/component B, and then they were melted at 180° C. by employing separate extruders. The melts were spun into alternate arrangement type composite filaments through a spinneret adapted to provide a cross-sectional filament configuration (in which elements of the two components are 6 each in number) as shown in FIG. 1, at a mass out flow rate from each orifice of 1.9 g/min. The filaments were quenched by a conventional quenching device, and then were drafted and attenuated and taken up at a drafting speed of 4300 m/min. by means of an air sucker disposed beneath the spinneret. Then, filaments were subjected to filament separation by a conventional filament-separating device and were filament-separated and laid up onto a moving screen conveyor so as to be formed into a nonwoven web comprised of composite filaments having a single filament fineness of 4.0 denier (fineness of high melting point component element=0.33 denier; fineness of low melting point component element=0.33 denier). The nonwoven web was subjected to bonding with heat and pressure by a bonding device with heat and pressure comprising an embossing roll, and a biodegradable filament nonwoven fabric having a weight per unit area of 30 g/$m^2$ was obtained. Bonding with heat and pressure was carried out under the same conditions as in EXAMPLE 1. Operational performance, nonwoven fabric properties, and biological degradation performance are shown in Table 1.

EXAMPLE 6

A nonwoven fabric comprised of alternate arrangement type composite filaments was produced using, as component A, a poly(butylenesuccinate) identical with the high melting point component used in EXAMPLE 1 and, as component B, a blend comprising 80 wt % of a copolymer polyester of butylenesuccinate/ethylenesuccinate=85/15 (mol %) identical with the low melting point component used in EXAMPLE 1 and 20 wt % of poly(butylenesuccinate) identical with the high melting point component used in EXAMPLE 1.

The components A and B were separately weighed so as to give a compound ratio of 1/1 in weight ratio for component A/component B, and then they were melted at 180° C. by employing separate extruders. The melts were spun into alternate arrangement type composite filaments through a spinneret adapted to provide a cross-sectional filament configuration (in which elements of the two components are 6 each in number) as shown in FIG. 1, at a mass out flow rate from each orifice of 2.0 g/min. The filaments were quenched by a conventional quenching device, and then were drafted and attenuated and taken up at a drafting speed of 4600 m/min. by means of an air sucker disposed beneath the spinneret. Then, filaments were subjected to filament separation by a conventional filament-separating device and were filament-separated and laid up onto a moving screen conveyor so as to be formed into a nonwoven web comprised of composite filaments having a single filament fineness of 4.0 denier (fineness of high melting point component element=0.33 denier; fineness of low melting point component element=0.33 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 1.

EXAMPLE 7

Alternate arrangement type composite filaments were melt spun from two components identical with those used in EXAMPLE 1, with a crystallizing agent added thereto. Master batches containing 20 wt % of a crystallizing agent having mean particle size of 1.0 μm, which was composed of talc/titanium oxide=1/1 in weight ratio, were previously prepared as bases for high melting point component and low melting point component polymers. The master batches were respectively blended with corresponding polymers in such a way that the amount of the crystallizing agent added to the high melting point component was 0.2 wt % and the amount of the crystallizing agent added to the low melting point component was 1.0 wt %. Alternate arrangement type composite filaments were melt spun under the same conditions as in EXAMPLE 1, except that the blend was used as raw material; that the spinneret used was such that it could provide a cross-sectional filament configuration in which the two components were each of 18 elements; and that the mass out flow rate from each orifice was set at 1.4 g/min. The filaments were quenched by a conventional quenching device, and then were drafted and attenuated and taken up by an air sucker at a drafting speed of 3500 m/min. Then, filaments were subjected to filament separation by a conventional filament-separating device and were filament-separated and laid up onto a moving screen conveyor so as to be formed into a nonwoven web comprised of composite filaments having a single filament fineness of 3.5 denier (fineness of high melting point component element=0.10 denier; fineness of low melting point component element=0.10 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 1.

EXAMPLE 8

Alternate arrangement type composite filaments were melt spun by using, as raw materials, two components identical with those used in EXAMPLE 1 and under the same conditions as in EXAMPLE 1, except that a melting temperature of 230° C. and a mass out flow rate from each orifice of 1.2 g/min. were used. The filaments were quenched by a conventional quenching device, and then were drafted and attenuated and taken up by an air sucker at a drafting speed of 4300 m/min. Then, filaments were subjected to filament separation by a conventional filament-separating device and were filament-separated and laid up onto a moving screen conveyor so as to be formed into a nonwoven web comprised of composite filaments having a single filament fineness of 2.5 denier (fineness of high melting point component element=0.21 denier; fineness of low melting point component element=0.21 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 2.

EXAMPLE 9

Alternate arrangement type composite filaments were melt spun by using, as raw materials, two components identical with those used in EXAMPLE 1 and under the same conditions as in EXAMPLE 1, except that a melting temperature of 230° C. and a mass out flow rate from each orifice of 3.2 g/min. were used. The filaments were quenched by a conventional quenching device, and then were drafted and attenuated and taken up by an air sucker at a drafting speed of 4700 m/min. Then, filaments were subjected to filament separation by a conventional filament-separating device and were filament-separated and laid up onto a moving screen conveyor so as to be formed into a nonwoven web comprised of composite filaments having a single filament fineness of 6.1 denier (fineness of high melting point component element=0.51 denier; fineness of low melting point component element=0.51 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 2.

EXAMPLE 10

Alternate arrangement type composite filaments were melt spun by using, as raw materials, two components identical with those used in EXAMPLE 1 and under the same conditions as in EXAMPLE 1, except that the spinneret used was such that it could provide a cross-sectional filament configuration in which both high melting point component and low melting point component were of 3 elements each. The filaments were quenched by a conventional quenching device, and then were drafted and attenuated and taken up by an air sucker at a drafting speed of 4000 m/min. Then, filaments were subjected to filament separation by a conventional filament-separating device and were filament-separated and laid up onto a moving screen conveyor so as to be formed into a nonwoven web comprised of composite filaments having a single filament fineness of 4.5 denier (fineness of high melting point component element=0.75 denier; fineness of low melting point component element=0.75 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 2.

EXAMPLE 11

Alternate arrangement type composite filaments were melt spun by using, as raw materials, two components identical with those used in EXAMPLE 1 and under the same conditions as in EXAMPLE 1, except that the spinneret used was such that it could provide a cross-sectional filament configuration in which both high melting point component and low melting point component were of 18 elements each. The filaments were quenched by a conventional quenching device, and then were drafted and attenuated and taken up by an air sucker at a drafting speed of 4200 m/min. Then, filaments were subjected to filament separation by a conventional filament-separating device and were filament-separated and laid up onto a moving screen conveyor so as to be formed into a nonwoven web comprised of composite filaments having a single filament fineness of 4.3 denier (fineness of high melting point component element=0.12 denier; fineness of low melting point component element=0.12 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 2.

EXAMPLE 12

Alternate arrangement type composite filaments were melt spun by using, as raw materials, two components identical with those used in EXAMPLE 1 and under the same conditions as in EXAMPLE 1, except that high melting point component and low melting point component were separately weighed to give a compound ratio of high melting point component/low melting point component=1/3 in weight ratio, and that the mass out flow rate from each orifice was set at 0.8 g/min. The filaments were quenched by a conventional quenching device, and then were drafted and attenuated and taken up by an air sucker at a drafting speed of 4000 m/min. Then, filaments were subjected to filament separation by a conventional filament-separating device and were filament-separated and laid up onto a moving screen conveyor so as to be formed into a nonwoven web comprised of composite filaments having a single filament fineness of 1.8 denier (fineness of high melting point component element=0.08 denier; fineness of low melting point component element=0.23 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 2.

EXAMPLE 13

Alternate arrangement type composite filaments were melt spun by using, as raw materials, two components identical with those used in EXAMPLE 1 and under the same conditions as in EXAMPLE 1, except that high melting point component and low melting point component were separately weighed to give a compound ratio of high melting point component/low melting point component=3/1 in weight ratio, and that the mass out flow rate from each orifice was set at 4.0 g/min. The filaments were quenched by a conventional quenching device, and then were drafted and attenuated and taken up by an air sucker at a drafting speed of 4900 m/min. Then, filaments were subjected to filament separation by a conventional filament-separating device and were filament-separated and laid up onto a moving screen conveyor so as to be formed into a nonwoven web comprised of composite filaments having a single filament fineness of 7.3 denier (fineness of high melting point component element=0.91 denier; fineness of low melting point component element=0.30 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 2.

EXAMPLE 14

Alternate arrangement type composite filaments were melt spun under the same conditions as in EXAMPLE 1. The filaments were quenched by a conventional quenching device, and then were drafted and attenuated and taken up by an air sucker at a drafting speed of 2000 m/min. Then, filaments were subjected to filament separation by a conventional filament-separating device and were filament-separated and laid up onto a moving screen conveyor so as to be formed into a nonwoven web comprised of composite filaments having a single filament fineness of 9.0 dernier (fineness of high melting point component element=0.75 denier; fineness of low melting point component element=0.75 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 3.

EXAMPLE 15

Alternate arrangement type composite filaments were melt spun under the same conditions as in EXAMPLE 1. The composite filaments were then drafted and attenuated and filament-separated, and laid up to be formed into a nonwoven web comprised of composite filaments having a single filament fineness of 4.0 denier (fineness of high melting point component element=0.33 denier; fineness of low melting point component element=0.33 denier). The nonwoven web was subjected to bonding with heat and pressure by a pin-sonic processing device by means of ultrasonic wave, and a biodegradable filament nonwoven fabric having a weight per unit area of 30 g/m$^2$ was obtained. Bonding with heat and pressure was carried out by using a roll having an engraved pattern area of 0.6 mm$^2$, with a compression dot density of 20 dots/cm$^2$ and a compression contact area ratio of 15%, with a frequency set at 19.15 kHz. Operational performance, nonwoven fabric properties, and biological degradation performance are shown in Table 3.

EXAMPLE 16

Alternate arrangement type composite filaments were melt spun under the same conditions as in EXAMPLE 1. The composite filaments were then drafted and attenuated and filament-separated, and laid up into a nonwoven web comprised of composite filaments having a single filament fineness of 4.0 denier (fineness of high melting point component element=0.33 denier; fineness of low melting point component element=0.33 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1, except that operating temperature was set at 102° C. Operational performance, nonwoven fabric properties, and biological degradation performance are shown in Table 3.

EXAMPLE 17

A biodegradable filament nonwoven fabric was produced under the same conditions as in EXAMPLE 1, except that a weight per unit area of 10 g/m$^2$ was adopted. Operational performance, nonwoven fabric properties, and biological degradation performance are shown in Table 3.

EXAMPLE 18

A biodegradable filament nonwoven fabric was produced under the same conditions as in EXAMPLE 1, except that a weight per unit area of 100 g/m$^2$ was adopted. Operational performance, nonwoven fabric properties, and biological degradation performance are shown in Table 3.

As may be clear from Tables 1, 2 and 3, EXAMPLE 1, wherein alternate arrangement type composite filaments of the invention which incorporate a copolymer polyester of butylenesuccinate/ethylenesuccinate as low melting point component were used, exhibited good filament quenching efficiency, good spinnability and good filament-separating efficiency, and also exhibited satisfactory mechanical characteristics. The nonwoven fabric exhibited good biodegradation capability.

EXAMPLE 2, wherein alternate arrangement type composite filaments of the invention which incorporate a copolymer polyester of butylenesuccinate/butylene-adipate as low melting point component were used, exhibited good filament quenching efficiency, good spinnability and good filament-separating efficiency, and also exhibited satisfactory mechanical characteristics. The nonwoven fabric exhibited good biodegradation capability.

EXAMPLE 3, wherein alternate arrangement type composite filaments of the invention which incorporate a copolymer polyester of butylenesuccinate/ethylene-succinate as low melting point component were used, exhibited good filament quenching efficiency, good spinnability and good filament-separating efficiency, despite the fact that the weight ratio of the butylenesuccinate in the copolymer polyester was smaller than that in EXAMPLE 1. It also exhibited satisfactory mechanical characteristics. The nonwoven fabric exhibited good biodegradation capability.

In EXAMPLE 4, despite the fact that the weight ratio of the butylenesuccinate in the copolymer polyester of butylenesuccinate/ethylenesuccinate used as low melting point component was larger than that in EXAMPLE 1, the use of the alternate arrangement type of composite filament of the invention provided good filament quenching efficiency, good spinnability and good filament-separating efficiency, and also satisfactory mechanical characteristics. The nonwoven fabric exhibited good biodegradation capability.

EXAMPLE 5, wherein a blend of poly(butylene-succinate) and a copolymer polyester of butylene-succinate/ethylene-succinate was used as component A, exhibited good spinnability, good filament-separating efficiency, and good mechanical characteristics, though slightly less satisfactory in respect of filament quenching efficiency. The nonwoven fabric exhibited even higher biodegradation capability than the nonwoven fabric obtained in EXAMPLE 1.

EXAMPLE 6, wherein a blend of a copolymer polyester of butylenesuccinate/ethylenesuccinate and poly (butylenesuccinate) was used as component B, was found even more satisfactory than EXAMPLE 1 in filament quenching efficiency, spinnability, and filament-separating efficiency. It also exhibited satisfactory mechanical characteristics. The nonwoven fabric exhibited even better biological degradation capability.

EXAMPLE 7 exhibited especially good performance in respect of filament quenching and filament-separating efficiencies because of the addition of crystallizing agent.

In EXAMPLE 8, as compared with EXAMPLE 1, the spinning temperature was higher, the mass out flow rate from each orifice was lower, and the filament size was finer. However, the use of the alternate arrangement type of composite filaments of the invention resulted in satisfactory filament quenching and filament-separating efficiencies despite the use of higher spinning temperature. Further, despite the fineness of the filament size good spinnability and satisfactory mechanical characteristics were exhibited. The nonwoven fabric was found to be highly biodegradable.

In EXAMPLE 9, as compared with EXAMPLE 1, the spinning temperature was higher, the mass out flow rate from each orifice was higher, and the filament size was coarser. However, the use of the alternate arrangement type of composite filaments of the invention provided satisfactory filament quenching and filament-separating efficiencies despite the use of higher spinning temperature. Further, good spinnability and satisfactory mechanical characteristics were exhibited. The nonwoven fabric was found to be highly biodegradable.

EXAMPLE 10, wherein the number of elements of each component was smaller than that in EXAMPLE 1, exhibited good filament quenching efficiency, good spinnability, good filament-separating efficiency, and satisfactory mechanical characteristics because of the use of the alternate arrangement type of composite filaments of the invention. The nonwoven fabric was found as having satisfactory biological degradability.

EXAMPLE 11, wherein the number of elements of each component was larger than that in EXAMPLE 1, exhibited good filament quenching efficiency, good spinnability, good filament-separating efficiency, and satisfactory mechanical characteristics because of the use of the alternate arrangement type of composite filaments of the invention. The nonwoven fabric exhibited satisfactory biological degradability.

EXAMPLE 12, wherein the compound ratio of the low melting point component was increased, and wherein the filament size was made finer, exhibited good filament quenching efficiency, good spinnability, good filament-separating efficiency, and satisfactory mechanical characteristics because of the use of the alternate arrangement type of composite filaments of the invention. The nonwoven fabric was found to be more satisfactory in biological degradability than the nonwoven fabric obtained in EXAMPLE 1.

EXAMPLE 13, wherein the compound ratio of the high melting point component was increased, and wherein the filament size was made coarser, exhibited good filament quenching efficiency, good spinnability, good filament-separating efficiency, and satisfactory mechanical characteristics because of the use of the alternate arrangement type of composite filaments of the invention. The nonwoven fabric exhibited satisfactory biological degradability because of the fact that the high melting point component was finely divided by the low melting point component.

In EXAMPLE 14, the filament drawing speed was made lower than in EXAMPLE 1, but nevertheless the use of the alternate arrangement type of composite filaments of the invention provided good filament cooling and opening efficiencies and good spinnability without inter-filament adhesion and filament breakage, though the mechanical characteristics of the nonwoven fabric was found slightly inferior. The nonwoven fabric was found as having good biodegradability.

EXAMPLE 15, wherein the nonwoven web obtained in EXAMPLE 1 was subjected to bonding with heat and pressure by a pin-sonic processing device by means of ultrasonic wave, provided a nonwoven fabric having satisfactory softness which was found somewhat inferior though in mechanical performance. The nonwoven fabric exhibited good biodegradability.

In EXAMPLE 16, the operating temperature in the bonding stage with heat and pressure was made higher than in EXAMPLE 1, but nevertheless the use of the alternate arrangement type of composite filaments of the invention provided good mechanical characteristics, though the nonwoven fabric was found slightly inferior in softness. The nonwoven fabric exhibited good biodegradability.

EXAMPLE 17, as a low-weight per unit area of nonwoven fabric obtained under the same condition as in EXAMPLE 1, exhibited good softness and had more satisfactory biodegradability than the nonwoven fabric obtained in EXAMPLE 1. This nonwoven fabric was found very suitable for sanitary end uses.

EXAMPLE 18, as a high-weight per unit area of nonwoven fabric obtained under the same conditions as in EXAMPLE 1, was slightly inferior in softness and biodegradability, but was found to be suitable for use in such applications as agricultural supplies and the like.

Manufacture of Nonwoven Fabrics Using Annularly Alternate Arrangement Type Composite Filaments

EXAMPLE 19

A nonwoven fabric comprised of annularly alternate arrangement type composite filaments was produced using, as high melting point component, a poly(butylenesuccinate) having an MFR value of 40 g/10 min., a melting point of 114° C., and a crystallizing temperature of 75° C., and as low melting point component, a copolymer polyester of butylenesuccinate/ethylenesuccinate=85/15 (mol %) having an MFR value of 30 g/10 min., a melting point of 102° C., and a crystallizing temperature of 52° C.

The two components were separately weighed so as to give a high melting point component/low melting point component compound ratio of 1/1 in weight ratio, and then they were melted at 180° C. by employing separate extruders. The melts were spun into annularly alternate arrangement type composite filaments through a spinneret adapted to provide a cross-sectional filament configuration (in which elements of the two components are 6 each in number) as shown in FIG. 2, at a mass out flow rate from each orifice of 1.8 g/min. The filaments were quenched by a conventional quenching device, and then were drafted and attenuated and taken up at a drafting speed of 4050 m/min. by means of an air sucker disposed beneath the spinneret. Then, filaments were subjected to filament separation by a conventional filament-separating device and were filament-separated and laid up onto a moving screen conveyor so as to be formed into a nonwoven web comprised of composite filaments having a single filament fineness of 4.0 denier (fineness of high melting point component element=0.33 denier; fineness of low melting point component element=0.33 denier) and a hollowness ratio of 20.3%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same condition as in EXAMPLE 1. Operational performance, nonwoven fabric properties, and biological degradation performance are shown in Table 4.

EXAMPLE 20

Annularly alternate arrangement type composite filaments were melt spun under the same conditions as in EXAMPLE 19, except that a copolymer polyester of butylenesuccinate/butyleneadipate=80/20 (mol %) having an MFR value of 25 g/10 min., a melting point of 94° C., and a crystallizing temperature of 48° C. was used as low melting point component, and that the compound ratio of high melting point component/low melting point component was 3/1 in weight ratio. The filaments were quenched by a conventional quenching device, and were then drafted and attenuated and taken up by an air sucker at a drafting speed of 4000 m/min. Then, filaments were subjected to filament separation by a conventional filament-separating device and were filament-separated and laid up onto a moving screen conveyor so as to be formed into a nonwoven web comprised of composite filaments having a single filament fineness of 4.1 denier (fineness of high melting point component element=0.51 denier; fineness of low melting point component element=0.17 denier) and a hollowness ratio of 21.2%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that operating temperature was set at 87° C. Operational performance, nonwoven fabric properties, and biological degradation performance are shown in Table 4.

EXAMPLE 21

Annularly alternate arrangement type composite filaments were melt spun under the same conditions as in EXAMPLE 19, except that a copolymer polyester of butylenesuccinate/ethylenesuccinate=70/30 (mol %) having an MFR value of 20 g/10 min., a melting point of 82° C., and a crystallizing temperature of 25° C. was used as low melting point component, and that the compound ratio of high melting point component/low melting point component was 3/1 in weight ratio. The filaments were quenched by a conventional quenching device, and were then drafted and attenuated and taken up by an air sucker at a drafting speed of 3200 m/min. Then, filaments were subjected to filament separation by a conventional filament-separating device and were filament-separated and laid up onto a moving screen conveyor so as to be formed into a nonwoven web comprised of composite filaments having a single filament fineness of 5.1 denier (fineness of high melting point component element=0.64 denier; fineness of low melting point component element=0.21 denier) and a hollowness ratio of 22.6%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that an operating temperature of 75° C. was used. Operational performance, nonwoven fabric properties, and biological degradation performance are shown in Table 4.

EXAMPLE 22

Annularly alternate arrangement type composite filaments were melt spun under the same conditions as in EXAMPLE 19, except that a copolymer polyester of butylenesuccinate/ethylenesuccinate=90/10 (mol %) having an MFR value of 30 g/10 min., a melting point of 106° C., and a crystallizing temperature of 58° C. was used as low melting point component, and that the compound ratio of high melting point component/low melting point component was 1/2 in weight ratio. The filaments were quenched by a conventional quenching device, and were then drafted and attenuated and taken up by an air sucker at a drafting speed of 4200 m/min. Then, filaments were subjected to filament separation by a conventional filament-separating device and were filament-separated and laid up onto a moving screen conveyor so as to be formed into a nonwoven web comprised of composite filaments having a single filament fineness of 3.9 denier (fineness of high melting point component element=0.22 denier; fineness of low melting point component element=0.43 denier) and a hollowness ratio of 20.5%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that an operating temperature of 99° C. was used. Operational performance, nonwoven fabric properties, and biological degradation performance are shown in Table 4.

EXAMPLE 23

Annularly alternate arrangement type composite filaments were melt spun from two components identical with those used in EXAMPLE 19, with a crystallizing agent added thereto. Master batches containing 20 wt % of a crystallizing agent having mean particle size of 1.0 μm, which is composed of talc/titanium oxide=1/1 in weight ratio, were previously prepared as bases for high melting point component and low melting point component polymers. The master batches were respectively blended with corresponding polymers in such a way that the amount of the crystallizing agent added to the high melting point component was 0.2 wt % and the amount of the crystallizing agent added to the low melting point component was 1.0 wt %. Annularly alternate arrangement type composite filaments were melt spun under the same conditions as in EXAMPLE 19, except that the blend was used as raw material; that the spinneret used was such that it could provide a cross-sectional filament configuration in which the two components were each of 18 elements; and that the mass out flow rate from each orifice was set at 1.4 g/min. The filaments were quenched by a conventional quenching device, and then were drafted and attenuated and taken up by an air sucker at a drafting speed of 3500 m/min. Then, filaments were subjected to filament separation by a conventional filament-separating device and were filament-separated and laid up onto a moving screen conveyor so as to be formed into a nonwoven web comprised of composite filaments having a single filament fineness of 3.5 denier (fineness of high melting point component element=0.10 denier; fineness of low melting point component element=0.10 denier) and a hollowness ratio of 15.6%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 4.

EXAMPLE 24

Annularly alternate arrangement type composite filaments were melt spun from two components identical with those used in EXAMPLE 19 under the same conditions as in EXAMPLE 19, except the spinneret used was such that it could provide a cross-sectional filament configuration in which the two components were each of 3 elements. The filaments were quenched by a conventional quenching device, and then were drafted and attenuated and taken up by an air sucker at a drafting speed of 4000 m/min. Then, filaments were subjected to filament separation by a conventional filament-separating device and were filament-separated and laid up onto a moving screen conveyor so as to be formed into a nonwoven web comprised of composite filaments having a single filament fineness of 4.1 denier (fineness of high melting point component element=0.68 denier; fineness of low melting point component element=0.68 denier) and a hollowness ratio of 20.0%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 4.

EXAMPLE 25

Annularly alternate arrangement type composite filaments were melt spun from two components identical with those used in EXAMPLE 19 under the same conditions as in EXAMPLE 19, except the spinneret used was such that it could provide a cross-sectional filament configuration in which the two components were each of 18 elements. The filaments were quenched by a conventional quenching device, and then were drafted and attenuated and taken up by an air sucker at a drafting speed of 3750 m/min. Then, filaments were subjected to filament separation by a conventional filament-separating device and were filament-separated and laid up onto a moving screen conveyor so as to be formed into a nonwoven web comprised of composite filaments having a single filament fineness of 4.3 denier (fineness of high melting point component element=0.12 denier; fineness of low melting point component element=0.12 denier) and a hollowness ratio of 16.8%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 4.

EXAMPLE 26

Annularly alternate arrangement type composite filaments were melt spun by using, as raw materials, two components identical with those used in EXAMPLE 19 and under the same conditions as in EXAMPLE 19, except that high melting point component and low melting point component were separately weighed to give a compound ratio of high melting point component/low melting point component=1/3 in weight ratio, and that the mass out flow rate from each orifice was set at 0.72 g/min. The filaments were quenched by a conventional quenching device, and were then drafted and attenuated and taken up by an air sucker at a drafting speed of 3600 m/min. Then, filaments were subjected to filament separation by a conventional filament-separating device and were filament-separate and laid up onto a moving screen conveyor so as to be formed into a nonwoven web comprised of composite filaments having a single filament fineness of 1.8 denier (fineness of high melting point component element=0.08 denier; fineness of low melting point component element=0.23 denier) and a hollowness ratio of 18.2%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 5.

EXAMPLE 27

Annularly alternate arrangement type composite filaments were melt spun by using, as raw materials, two components identical with those used in EXAMPLE 19 and under the same conditions as in EXAMPLE 19, except that high melting point component and low melting point component were separately weighed to give a compound ratio of high melting point component/low melting point component=3/1 in weight ratio, and that the mass out flow rate from each orifice was set at 3.5 g/min. The filaments were quenched by a conventional quenching device, and were then drafted and attenuated and taken up by an air sucker at a drafting speed of 4500 m/min. Then, filaments were subjected to filament separation by a conventional filament-separating device and were filament-separated and laid up onto a moving screen conveyor so as to be formed into a nonwoven web comprised of composite filaments having a single filament fineness of 7.0 denier (fineness of high melting point component element=0.88 denier; fineness of low melting point component element=0.29 denier) and a hollowness ratio of 23.5%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 5.

EXAMPLE 28

Annularly alternate arrangement type composite filaments were melt spun by using, as raw materials, two components identical with those used in EXAMPLE 19 and under the same conditions as in EXAMPLE 19, except that a spinning temperature of 250° C. was used, and that the mass out flow rate from each orifice was set at 0.72 g/min. The filaments were quenched by a conventional quenching device, and were then drafted and attenuated and taken up by an air sucker at a drafting speed of 3800 m/min. Then, filaments were subjected to filament separation by a conventional filament-separating device and were filament-separated and laid up onto a moving screen conveyor so as to be formed into a nonwoven web comprised of composite filaments having a single filament fineness of 1.7 denier (fineness of high melting point component element=0.14 denier; fineness of low melting point component element=0.14 denier) and a hollowness ratio of 5.0%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 5.

EXAMPLE 29

Annularly alternate arrangement type composite filaments were melt spun by using, as raw materials, two components identical with those used in EXAMPLE 19 and under the same conditions as in EXAMPLE 19, except that a spinning temperature of 160° C. was used and that the mass out flow rate from each orifice was set at 3.5 g/min. The filaments were quenched by a conventional quenching device, and were then drafted and attenuated and taken up by an air sucker at a drafting speed of 3200 m/min. Then, filaments were subjected to filament separation by a conventional filament-separating device and were filament-separated and laid up onto a moving screen conveyor so as to be formed into a nonwoven web comprised of composite filaments having a single filament fineness of 9.8 denier (fineness of high melting point component element=0.82 denier; fineness of low melting point component element=0.82 denier) and a hollowness ratio of 30.0%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 5.

EXAMPLE 30

Annularly alternate arrangement type composite filaments were melt spun under the same conditions as in EXAMPLE 19. The filaments were quenched by a conventional quenching device, and were then drafted and attenuated and taken up by an air sucker at a drafting speed of 2000 m/min. Then, filaments were subjected to filament separation by a conventional filament-separating device and were filament-separated and laid up onto a moving screen conveyor so as to be formed into a nonwoven web comprised of composite filaments having a single filament fineness of 8.1 denier (fineness of high melting point component element=0.68 denier; fineness of low melting point component element= 0.68 denier) and a hollowness ratio of 19.6%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 5.

EXAMPLE 31

Annularly alternate arrangement type composite filaments were melt spun under the same conditions as in EXAMPLE 19. Then, filaments were subjected to filament separation and fine drawing, being thus filament-separated and laid up in the form of a nonwoven web comprised of composite filaments having a single filament fineness of 4.0 denier (fineness of high melting point component element=0.33 denier; fineness of low melting point component element= 0.33 denier) and a hollowness ratio of 20.3%. The nonwoven web was subjected to bonding with heat and pressure by a pin-sonic processing apparatus by means of ultrasonic wave, and a biodegradable filament nonwoven fabric having a weight per unit area of 30 g/m$^2$ was obtained. Bonding with heat and pressure was carried out under the same conditions as in EXAMPLE 15. Operational performance, nonwoven fabric properties, and biological degradation performance are shown in Table 5.

EXAMPLE 32

Annularly alternate arrangement type composite filaments were melt spun under the same conditions as in EXAMPLE 19. Then, filaments were subjected to filament separation and fine drawing, being thus filament-separated and laid up in the form of a nonwoven web comprised of composite filaments having a single filament fineness of 4.0 denier (fineness of high melting point component element=0.33 denier; fineness of low melting point component element= 0.33 denier) and a hollowness ratio of 20.3%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that an operating temperature of 67° C. was used. Operational performance, nonwoven fabric properties, and biological degradation performance are shown in Table 6.

EXAMPLE 33

Annularly alternate arrangement type composite filaments were melt spun under the same conditions as in EXAMPLE 19. Then, filaments were subjected to filament separation and drafting and attenuation, being thus filament-separated and laid up in the form of a nonwoven web comprised of composite filaments having a single filament fineness of 4.0 denier (fineness of high melting point component element= 0.33 denier; fineness of low melting point component element=0.33 denier) and a hollowness ratio of 20.3%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that an operating temperature of 77° C. was used. Operational performance, nonwoven fabric properties, and biological degradation performance are shown in Table 6.

EXAMPLE 34

Annularly alternate arrangement type composite filaments were melt spun under the same conditions as in EXAMPLE 19. Then, filaments were subjected to filament separation and drafting and attenuation, being thus filament-separated and laid up in the form of a nonwoven web comprised of composite filaments having a single filament fineness of 4.0 denier (fineness of high melting point component element= 0.33 denier; fineness of low melting point component element=0.33 denier) and a hollowness ratio of 20.3%. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that an operating temperature of 102° C. was used. Operational performance, nonwoven fabric properties, and biological degradation performance are shown in Table 6.

As may be clearly seen from Tables 4, 5 and 6, EXAMPLE 19, wherein annularly alternate arrangement type composite filament of the invention which incorporate a copolymer polyester of butylenesuccinate/ethylenesuccinate as low melting point component was used, exhibited good filament quenching efficiency, good spinnability and good filament-separating efficiency, and also exhibited satisfactory mechanical characteristics. The nonwoven fabric exhibited good biodegradation capability.

EXAMPLE 20, wherein annularly alternate arrangement type composite filament of the invention which incorporates a copolymer polyester of butylenesuccinate/butyleneadipate as low melting point component was used, exhibited good filament quenching efficiency, good spinnability and good filament-separating efficiency, and also exhibited satisfactory mechanical characteristics. The nonwoven fabric exhibited good biodegradation capability.

In EXAMPLE 21, the weight ratio of butylenesuccinate in the copolymer polyester of butylene-succinate/ethylene-succinate used as low melting point component was lower than that in EXAMPLE 19, but through the application of annularly alternate arrangement type composite filament of the invention, the compound ratio of the high melting point component was increased and accordingly the proportion of butylenesuccinate was increased. Thus, satisfactory performance was witnessed in respect of filament quenching, spinnability, and filament separation. Mechanical performance was also found satisfactory. The nonwoven fabric exhibited good biodegradation capability.

In EXAMPLE 22, the weight ratio of butylenesuccinate in the copolymer polyester of butylenesuccinate/ethylenesuccinate used as low melting point component was higher than that in EXAMPLE 19, but through the application of annularly alternate arrangement type composite filament of the invention, the compound ratio of the low melting point component was increased and accordingly the proportion of butylenesuccinate/ethylenesuccinate was increased. Thus, satisfactory performance was witnessed in respect of filament quenching, spinnability, and filament separation. Mechanical performance was also found satisfactory. The nonwoven fabric exhibited satisfactory biodegradability.

EXAMPLE 23 was found to be especially satisfactory in respect of filament quenching and filament-separating efficiencies because of addition of crystallizing agent.

In EXAMPLE 24, despite the fact that the number of elements of each component was smaller than that in EXAMPLE 19, the use of annularly alternate arrangement type composite filament of the invention resulted in satisfactory performance in respect of filament quenching efficiency, spinnability, and filament-separating efficiency. Good mechanical performance was also witnessed. The nonwoven fabric exhibited good biodegradability.

In EXAMPLE 25, the number of elements of each component was larger than that in EXAMPLE 19, but the application of annularly alternate arrangement type composite filament of the invention provided good filament quenching efficiency, good spinnability, and good filament-separating efficiency. Also, mechanical performance was found satisfactory. The nonwoven fabric exhibited good biodegradability.

In EXAMPLE 26, the compound ratio of the low melting point component was increased, and the filament size was made finer, but the application of annularly alternate arrangement type composite filament of the invention provided good filament quenching efficiency, good spinnability, and good filament-separating efficiency. Also, mechanical performance was found satisfactory. The nonwoven fabric exhibited even higher biodegradability than the nonwoven fabric obtained in EXAMPLE 19.

In EXAMPLE 27, the compound ratio of the high melting point component was increased, and the filament size was made coarser, but the application of annularly alternate arrangement type composite filament of the invention provided good filament quenching efficiency, good spinnability, and good filament-separating efficiency. Also, mechanical performance was found satisfactory. The nonwoven fabric exhibited satisfactory biological degradability because the high melting point component was finely divided by the low melting point component.

In EXAMPLE 28, a higher spinning temperature was used, the mass out flow rate from each orifice was lowered, and the hollowness ratio was made lower than that in EXAMPLE 19, but the application of annularly alternate arrangement type composite filament of the invention provided good filament quenching efficiency, good spinnability, and good filament-separating efficiency. Also, mechanical performance was found satisfactory. The nonwoven fabric exhibited satisfactory biological degradability.

In EXAMPLE 29, a lower spinning temperature was used, the mass out flow rate from each orifice was increased, and the hollowness ratio was made higher than that in EXAMPLE 19, but the application of annularly alternate arrangement type composite filament of the invention provided good filament quenching efficiency, good spinnability, and good filament-separating efficiency. Also, mechanical performance was found satisfactory, though the coarseness of the filament size somewhat affected the softness aspect. The nonwoven fabric exhibited satisfactory biological degradability.

In EXAMPLE 30, a lower drafting speed was used as compared with that in EXAMPLE 19, but nevertheless the application of annularly alternate arrangement type composite filament of the invention provided good filament quenching efficiency and good spinnability. Mechanical performance was also found satisfactory, though the nonwoven fabric was less favorable in filament-separating efficiency and softness. This nonwoven fabric exhibited good biological degradation capability.

In EXAMPLE 31, the nonwoven web obtained in EXAMPLE 19 was subjected to bonding with heat and pressure by a pin-sonic processing apparatus by means of ultrasonic wave, and therefore the resulting nonwoven fabric exhibited excellent softness, though it was found somewhat less favorable in mechanical performance.

In EXAMPLE 32, the operating temperature applied at the bonding stage with heat and pressure was very low as compared with the preferred temperature range of the invention, the resulting nonwoven fabric was rather unfavorable in mechanical characteristics and was found liable to produce fuzz. However, it exhibited excellent softness. Further, this nonwoven fabric was found satisfactory in biodegradability.

In EXAMPLE 33, a lower operating temperature was used in the bonding stage with heat and pressure, but the use of annularly alternate arrangement type composite filament of the invention resulted in a nonwoven fabric having excellent softness, less favorable though in mechanical characteristics. The nonwoven fabric exhibited good biodegradability.

In EXAMPLE 34, a higher operating temperature was used in the bonding stage with heat and pressure, but the use of annularly alternate arrangement type composite filament of the invention resulted in a nonwoven fabric having excellent mechanical characteristics, less favorable though in softness. The nonwoven fabric exhibited good biodegradability.

Manufacture of Nonwoven Fabrics Using Multileaf Type Composite Filaments

EXAMPLE 35

A nonwoven fabric comprised of multileaf type composite filaments was produced using, as high melting point component, a poly(butylenesuccinate) having an MFR value of 20 g/10 min., a melting point of 114° C., and a crystallizing temperature of 75° C., and as low melting point component, a copolymer polyester of butylenesuccinate/ethylenesuccinate=85/15 (mol %) having an MFR value of 30 g/10 min., a melting point of 102° C., and a crystallizing temperature of 52° C.

The two components were separately weighed so as to give a high melting point component/low melting point component compound ratio of 1/1 in weight ratio, and then they were melted at 180° C. by employing separate extruders. The melts were spun into multileaf type composite filaments through a spinneret adapted to provide a cross-sectional filament configuration (in which projections of high melting point component are 6 each in number) as shown in FIG. 3, at a mass out flow rate from each orifice of 1.9 g/min. The filaments were quenched by a conventional quenching device, and then drafted and attenuated and taken up at a drafting speed of 4200 m/min. by means of an air sucker disposed beneath the spinneret. Then, filaments were subjected to filament separation by a conventional filament-separating device and were filament-separated and laid up onto a moving screen conveyor so as to be formed into a nonwoven web comprised of composite filaments having a single filament fineness of 4.1 denier (fineness of high melting point component element=0.34 denier×6; fineness of low melting point component element=2.0 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same condition as in EXAMPLE 1, except that an operating temperature of 95° C. was used. Operational performance, nonwoven fabric properties, and biological degradation performance are shown in Table 7.

EXAMPLE 36

Multileaf type composite filaments were melt spun under the same conditions as in EXAMPLE 35, except that a copolymer polyester of butylenesuccinate/butyleneadipate=80/20 (mol %) having an MFR value of 30 g/10 min., a melting point of 105° C., and a crystallizing temperature of 29° C. was used as low melting point component. The filaments were quenched by a conventional quenching device, and were then drafted and attenuated and taken up by an air sucker at a drafting speed of 3900 m/min. Then, filaments were subjected to filament separation by a conventional filament-separating device and were filament-separated and laid up onto a moving screen conveyor so as to be formed into a nonwoven web comprised of composite filaments having a single filament fineness of 4.4 denier (fineness of high melting point component element=0.37 denier×6; fineness of low melting point component element=2.2 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that operating temperature was set at 98° C. Operational performance, nonwoven fabric properties, and biological degradation performance are shown in Table 7.

EXAMPLE 37

Multileaf type composite filaments were melt spun under the same conditions as in EXAMPLE 35, except that a copolymer polyester of butylenesuccinate/butylenesebacate=85/15 (mol %) having an MFR value of 30 g/10 min., a melting point of 105° C., and a crystallizing temperature of 32° C. was used as low melting point component. The filaments were quenched by a conventional quenching device, and were then drafted and attenuated and taken up by an air sucker at a drafting speed of 3800 m/min. Then, filaments were subjected to filament separation by a conventional filament-separating device and were filament-separated and laid up onto a moving screen conveyor so as to be formed into a nonwoven web comprised of composite filaments having a single filament fineness of 4.5 denier (fineness of high melting point component element=0.38 denier×6; fineness of low melting point component element=2.3 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that operating temperature was set at 98° C. Operational performance, nonwoven fabric properties, and biological degradation performance are shown in Table 7.

EXAMPLE 38

Multileaf type composite filaments were melt spun under the same conditions as in EXAMPLE 35, except that a copolymer polyester of butylenesuccinate/ethylenesuccinate=80/20 (mol %) having an MFR value of 20 g/10 min., a melting point of 96° C., and a crystallizing temperature of 40° C. was used as high melting point component, and that a copolymer polyester of butylenesuccinate/ethylenesuccinate=70/30 (mol %) having an MFR value of 30 g/10 min., a melting point of 90° C., and a crystallizing temperature of 25° C. was used as low melting point component. The filaments were quenched by a conventional quenching device, and were then drafted and attenuated and taken up by an air sucker at a drafting speed of 3700 m/min. Then, filaments were subjected to filament separation by a conventional filament-separating device and were filament-separated and laid up onto a moving screen conveyor so as to be formed into a nonwoven web comprised of composite filaments having a single filament fineness of 4.6 denier (fineness of high melting point component element=0.39 denier×6; fineness of low melting point component element=2.3 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding was carried out under the same conditions as in EXAMPLE 1 except that operating temperature was set at 83° C. Operational performance, nonwoven fabric properties, and biological degradation performance are shown in Table 7.

EXAMPLE 39

Multileaf type composite filaments were melt spun under the same conditions as in EXAMPLE 35, except that a copolymer polyester of butylenesuccinate/butyleneadipate=90/10 (mol %) having an MFR value of 20 g/10 min., a melting point of 110° C., and a crystallizing temperature of 52° C. was used as high melting point component. The filaments were quenched by a conventional quenching device, and were then drafted and attenuated and taken up by an air sucker at a drafting speed of 3500 m/min. Then, filaments were subjected to filament separation by a conventional filament-separating device and were filament-separated and laid up onto a moving screen conveyor so as to be formed into a nonwoven web comprised of composite filaments having a single filament fineness of 4.9 denier (fineness of high melting point component element=0.41 denier×6; fineness of low melting point component element=2.4 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 7.

EXAMPLE 40

Multileaf type composite filaments were melt spun under the same conditions as in EXAMPLE 35, except that a copolymer polyester of butylenesuccinate/butylenesebacate=90/10 (mol %) having an MFR value of 20 g/10 min., a melting point of 110° C., and a crystallizing temperature of 54° C. was used as high melting point component. The filaments were quenched by a conventional quenching device, and were then drafted and attenuated and taken up by an air sucker at a drafting speed of 3400 m/min. Then, filaments were subjected to filament separation by a conventional filament-separating device and were filament-separated and laid up onto a moving screen conveyor so as to be formed into a nonwoven web comprised of composite filaments having a single filament fineness of 5.0 denier (fineness of high melting point component element=0.42 denier×6; fineness of low melting point component element=2.5 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 7.

EXAMPLE 41

Multileaf type composite filaments were melt spun under the same conditions as in EXAMPLE 35, except that a poly(L-lactic acid) having an MFR value of 12 g/10 min., a melting point of 178° C., and a crystallizing temperature of 103° C. was used as high melting point component; that a copolymer polyester of L-lactic acid/ε-caprolactone=85/15 (mol %) having an MFR value of 35 g/10 min., a melting point of 154° C., and a crystallizing temperature of 28° C. was used as low melting point component; and that a spinning temperature of 240° C. as used. The filaments were quenched by a conventional quenching device, and were then drafted and attenuated and taken up by an air sucker at a drafting speed of 3800 m/min. Then, filaments were subjected to filament separation by a conventional filament-separating device and were filament-separated and laid up onto a moving screen conveyor so as to be formed into a nonwoven web comprised of composite filaments having a single filament fineness of 4.5 denier (fineness of high melting point component element=0.38 denier×6; fineness of low melting point component element=2.3 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that operating temperature was set at 147° C. Operational performance, nonwoven fabric properties, and biological degradation performance are shown in Table 8.

EXAMPLE 42

Multileaf type composite filaments were melt spun under the same conditions as in EXAMPLE 35, except that a poly(D, L-lactic acid) of L-lactic acid/D-lactic acid=90/10 (mol %) having an MFR value of 20 g/10 min. and a melting point of 141° C. was used as high melting point component; that a copolymer polyester of L-lactic acid/glycolic acid=80/20 (mol %) having an MFR value of 20 g/10 min. and a melting point of 111° C. was used as low melting point component; and that a spinning temperature of 170° C. and a mass out flow rate from each orifice of 1.4 g/min were applied. The filaments were quenched by a conventional quenching device, and were then drafted and attenuated and taken up by an air sucker at a drafting speed of 3500 m/min. Then, filaments were subjected to filament separation by a conventional filament-separating device and were filament-separated and laid up onto a moving screen conveyor so as to be formed into a nonwoven web comprised of composite filaments having a single filament fineness of 3.5 denier (fineness of high melting point component element=0.29 denier×6; fineness of low melting point component element=1.75 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out by using an embossing ing roll having a 3.1 mm$^2$ area of circular engraved pattern disposed so as to give a compression contact dot density of 6.7 dots/cm$^2$ and a compression area ratio of 6.1%, and smooth surfaced metallic roll, at an operating temperature of 106° C. with roll linear pressure set at 40 kg/cm. Operational performance, nonwoven fabric properties, and biological degradation performance are shown in Table 8.

EXAMPLE 43

Multileaf type composite filaments were melt spun under the same conditions as in EXAMPLE 35, except that a copolymer polyester of butylenesuccinate/ethylenesuccinate=70/30 (mol %) having an MFR value of 30 g/10 min., a melting point of 92° C., and a crystallizing temperature of 20° C. was used as low melting point component. The filaments were quenched by a conventional quenching device, and were then drafted and attenuated and taken up by an air sucker at a drafting speed of 3900 m/min. Then, filaments were subjected to filament separation by a conventional filament-separating device and were filament-separated and laid up onto a moving screen conveyor so as to be formed into a nonwoven web comprised of composite filaments having a single filament fineness of 4.4 denier (fineness of high melting point component element=0.37 denier×6; fineness of low melting point component element=2.2 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1, except that the operating temperature was set at 85° C. Operational performance, nonwoven fabric properties, and biological degradation performance are shown in Table 8.

EXAMPLE 44

Multileaf type composite filaments were melt spun under the same conditions as in EXAMPLE 35, except that a copolymer polyester of butylenesuccinate/ethylenesuccinate=90/10 (mol %) having an MFR value of 30 g/10 min., a melting point of 108° C., and a crystallizing temperature of 57° C. was used as low melting point component. The filaments were quenched by a conventional quenching device, and were then drafted and attenuated and taken up by an air sucker at a drafting speed of 4200 m/min. Then, filaments were subjected to filament separation by a conventional filament-separating device and were filament-separatedand laid up onto a moving screen conveyor so as to be formed into a nonwoven web comprised of composite filaments having a single filament fineness of 4.0 denier (fineness of high melting point component element=0.34 denier×6; fineness of low melting point component element=2.0 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1, except that the operating temperature was set at 101° C. Operational performance, nonwoven fabric properties, and biological degradation performance are shown in Table 8.

EXAMPLE 45

Multileaf type composite filaments were melt spun under the same conditions as in EXAMPLE 35, except that a poly(butylenesuccinate) having an MFR value of 5 g/10 min, a melting point of 114° C., and crystallizing temperature of 75° C. was used as high melting point component, and that a copolymer polyester of butylenesuccinate/ethylenesuccinate=85/15 (mol %) having an MFR value of 10 g/10 min., a melting point of 102° C., and a crystallizing temperature of 52° C. was used as low melting point component. The filaments were quenched by a conventional quenching device, and were then drafted and attenuated and taken up by an air sucker at a drafting speed of 3500 m/min. Then, filaments were subjected to filament separation by a conventional filament-separating device and were filament-separatedand laid up onto a moving screen conveyor so as to be formed into a nonwoven web comprised of composite filaments having a single filament fineness of 4.9 denier (fineness of high melting point component element=0.41 denier×6; fineness of low melting point component element=2.5 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 8.

EXAMPLE 46

Multileaf type composite filaments were melt spun under the same conditions as in EXAMPLE 35, except that a poly(butylenesuccinate) having an MFR value of 50 g/10 min, a melting point of 114° C., and crystallizing temperature of 75° C. was used as high melting point component, and that a copolymer polyester of butylenesuccinate/ethylenesuccinate=85/15 (mol %) having an MFR value of 60 g/10 min., a melting point of 102° C., and a crystallizing temperature of 52° C. was used as low melting point component. The filaments were quenched by a conventional quenching device, and were then drafted and attenuated and taken up by an air sucker at a drafting speed of 4500 m/min. Then, filaments were subjected to filament separation by a conventional filament-separating device and were filament-separatedand laid up onto a moving screen conveyor so as to be formed into a nonwoven web comprised of composite filaments having a single filament fineness of 3.8 denier (fineness of high melting point component element=0.32 denier×6; fineness of low melting point component element=1.9 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 8.

EXAMPLE 47

Figure 4:
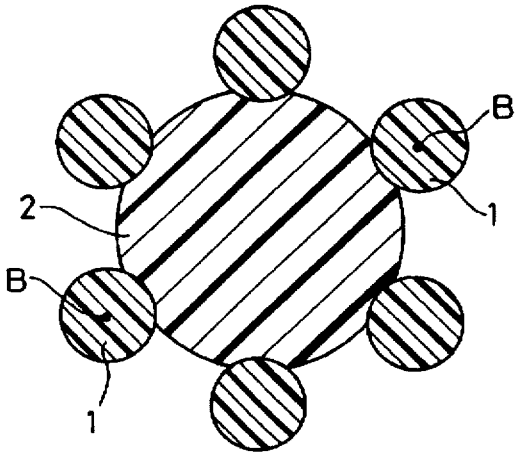
FIG. 4 is a model diagram of a filament cross section of a multileaf type composite filament representing another form of the constituent filament of the invention.
Figure 5:
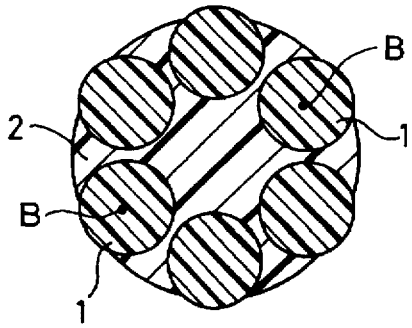
FIG. 5 is a model diagram of a filament cross section of a multileaf type composite filament representing still another form of the constituent filament of the invention.

Multileaf type composite filaments were melt spun by using, as raw material, two components identical with those used in EXAMPLE 35 and under the same conditions as in EXAMPLE 35, except that a spinneret adapted to provide a filament cross-section of such configuration of high melting point component arrangement (number of high melting point component projections=6) as shown in FIG. 4 was used. The filaments were quenched by a conventional quenching device, and were then drafted and attenuated and taken up by an air sucker at a drafting speed of 3800 m/min. Then, filaments were subjected to filament separation by a conventional filament-separating device and were filament-separatedand laid up onto a moving screen conveyor so as to be formed into a nonwoven web comprised of composite filaments having a single filament fineness of 4.0 denier (fineness of high melting point component element=0.34 denier×6; fineness of low melting point component element=2.0 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 9.

EXAMPLE 48

Multileaf type composite filaments were melt spun by using, as raw material, two components identical with those used in EXAMPLE 35 and under the same conditions as in EXAMPLE 35, except that the number of projections of high melting point component is 4, and that a spinneret adapted to provide a filament cross-section of such configuration as shown in FIG. 2 was used. The filaments were quenched by a conventional quenching device, and were then drafted and attenuated and taken up by an air sucker at a drafting speed of 4000 m/min. Then, filaments were subjected to filament separation by a conventional filament-separating device and were filament-separatedand laid up onto a moving screen conveyor so as to be formed into a nonwoven web comprised of composite filaments having a single filament fineness of 4.3 denier (fineness of high melting point component element=0.53 denier×4; fineness of low melting point component element=2.1 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 9.

EXAMPLE 49

Figure 3:
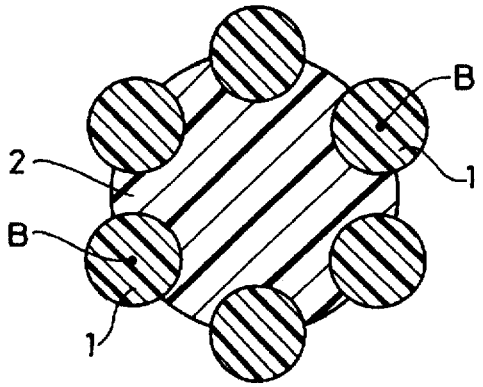
FIG. 3 is a model diagram of a filament cross section of a multileaf type composite filament representing still another form of the constituent filament of the invention.

Multileaf type composite filaments were melt spun by using, as raw material, two components identical with those used in EXAMPLE 35 and under the same conditions as in EXAMPLE 35, except that the number of projections of high melting point component is 10, and that a spinneret adapted to provide a filament cross-section of such configuration as shown in FIG. 3 was used. The filaments were quenched by a conventional quenching device, and were then drafted and attenuated and taken up by an air sucker at a drafting speed of 4300 m/min. Then, filaments were subjected to filament separation by a conventional filament-separating device and were filament-separatedand laid up onto a moving screen conveyor so as to be formed into a nonwoven web comprised of composite filaments having a single filament fineness of 4.0 denier (fineness of high melting point component element=0.20 denier=10; fineness of low melting point component element=2.0 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 9.

EXAMPLE 50

Multileaf type composite filaments were melt spun by using, as raw material, two components identical with those used in EXAMPLE 35 and under the same conditions as in EXAMPLE 35, except that the two components were separately weighed so as to give a compound ratio of high melting point component/low melting point component=1/3 in weight ratio, and that the mass out flow rate from each orifice was set at 2.0 g/min. The filaments were quenched by a conventional quenching device, and were then drafted and attenuated and taken up by an air sucker at a drafting speed of 4000 m/min. Then, filaments were subjected to filament separation by a conventional filament-separating device and were filament-separatedand laid up onto a moving screen conveyor so as to be formed into a nonwoven web comprised of composite filaments having a single filament fineness of 4.5 denier (fineness of high melting point component element=0.19 denier×6; fineness of low melting point component element=3.4 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 10.

EXAMPLE 51

Multileaf type composite filaments were melt spun by using, as raw material, two components identical with those used in EXAMPLE 35 and under the same conditions as in EXAMPLE 35, except that the two components were separately weighed so as to give a compound ratio of high melting point component/low melting point component=3/1 in weight ratio, and that the mass out flow rate from each orifice was set at 2.0 g/min. The filaments were quenched by a conventional quenching device, and were then drafted and attenuated and taken up by an air sucker at a drafting speed of 4400 m/min. Then, filaments were subjected to filament separation by a conventional filament-separating device and were filament-separatedand laid up onto a moving screen conveyor so as to be formed into a nonwoven web comprised of composite filaments having a single filament fineness of 4.1 denier (fineness of high melting point component element=0.52 denier×6; fineness of low melting point component element=1.0 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 10.

EXAMPLE 52

Multileaf type composite filaments were melt spun under the same conditions as in EXAMPLE 35. The filaments were quenched by a conventional quenching device, and were then drafted and attenuated and taken up by an air sucker at a drafting speed of 1800 m/min. Then, filaments were subjected to filament separation by a conventional filament-separating device and were filament-separatedand laid up onto a moving screen conveyor so as to be formed into a nonwoven web comprised of composite filaments having a single filament fineness of 9.5 denier (fineness of high melting point component element=0.79 denier×6; fineness of low melting point component element=4.8 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 10.

EXAMPLE 53

Multileaf type composite filaments were melt spun under the same conditions as in EXAMPLE 35. The filaments were quenched by a conventional quenching device, and were then drafted and attenuated and taken up by an air sucker at a drafting speed of 2000 m/min. Then, filaments were subjected to filament separation by a conventional filament-separating device and were filament-separatedand laid up onto a moving screen conveyor so as to be formed into a nonwoven web comprised of composite filaments having a single filament fineness of 8.6 denier (fineness of high melting point component element=0.72 denier×6; fineness of low melting point component element=4.3 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1. Operational performance, nonwoven fabric properties, and biological degradation performance are shown in Table 10.

EXAMPLE 54

Multileaf type composite filaments were melt spun under the same conditions as in EXAMPLE 35. The filaments were then drafted and attenuated, filament-separatedand laid up in the form of a nonwoven web comprised of composite filaments having a single filament fineness of 4.1 denier (fineness of high melting point component element=0.34 denier×6; fineness of low melting point component element =2.0 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 15. Operational performance, nonwoven fabric properties and biological degradation performance are shown in Table 10.

EXAMPLE 55

Multileaf type composite filaments were melt spun under the same conditions as in EXAMPLE 35. The filaments were then drafted and attenuated, filament-separatedand laid up in the form of a nonwoven web comprised of composite filaments having a single filament fineness of 4.1 denier (fineness of high melting point component element=0.34 denier×6; fineness of low melting point component element=2.0 denier). The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1, except that the operating temperature was set at 98° C. Operational performance, nonwoven fabric properties, and biological degradation performance are shown in Table 10.

EXAMPLE 56

Multileaf type composite filaments were melt spun from two components identical with those used in EXAMPLE 35 except in that the high melting point component having an MFR value of 40 g/10 min. was used, with a crystallizing agent added thereto. Master batches containing 20 wt % of a crystallizing agent having mean particle size of 1.0 μm, which is composed of talc/titanium oxide=1/1 in weight ratio, were previously prepared as bases for high melting point component and low melting point component polymers. The master batches were respectively blended with corresponding polymers in such a way that the amount of the crystallizing agent added to the high melting point component was 0.2 wt % and the amount of the crystallizing agent added to the low melting point component was 1.0 wt %. Multileaf type composite filaments were melt spun under the same conditions as in EXAMPLE 35, except that the blend was used as raw material; and that the mass out flow rate from each orifice was set at 1.35 g/min. The filaments were quenched by a conventional quenching device, and then were drafted and attenuated and taken up by an air sucker disposed below the spinneret at a drafting speed of 3500 m/min. Then, filaments were subjected to filament separation by a conventional filament-separating device and were gathered and laid up onto a moving screen conveyor so as to be formed into a nonwoven web comprised of filaments having a single filament fineness of 3.5 denier. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out by using an embossing ing roll having a 0.68 mm$^2$ area of circular engraved pattern disposed so as to give a compression contact dot density of 16 dots/cm$^2$ and a compression area ratio of 7.6%, and smooth surfaced metallic roll, at an operating temperature of 95° C. Operating conditions, operational performance, nonwoven fabric properties, and biological degradation performance are shown in Table 11.

EXAMPLES 57–60

Filament nonwoven fabrics were produced in the same manner as in EXAMPLE 56, except that the amounts of crystallizing agent added to respective components in EXAMPLE 56 were changed as shown in Table 11. Operating conditions, operational performance, nonwoven fabric properties, and biological degradation performance are shown in Table 11.

EXAMPLES 61, 62

A master batch containing 20 wt % of a talc powder having mean particle size of 1.0 μm as crystallizing agent, and a master batch containing 20 wt % of calcium carbonate having means particle size of 1.5 μm as crystallizing agent were previously prepared as polymer bases for high melting point component and low melting point component respectively in the same way as in EXAMPLE 56. Filament nonwoven fabrics were produced in the same way as in EXAMPLE 56, except that the amounts of crystallizing agent added to respective components were changed as shown in Table 12. Operating conditions, operational performance, nonwoven fabric properties, and biological degradation performance are shown in Table 12.

EXAMPLE 63

A copolymer of butylenesuccinate/butyleneadipate=80/20 (mol %) having an MFR value of 25 g/10 min, a melting point of 94° C., and a crystallizing temperature of 48° C., was used as low melting point component polymer. A master batch containing 20 wt % of a 1/1 in weight ratio mixture of talc powder, 3.4 μm in mean particle size, and titanium oxide, 1.0 μm in mean particle size, as crystallizing agent, was previously prepared as a low melting point component polymer base. The master batch was blended with the low melting point component polymer in such a way that the crystallizing agent was to be added to the low melting point component in the amount of 3.0 wt %. A filament nonwoven fabric was produced in the same way as in EXAMPLE 56, except that the blend was used as raw material. Operating conditions, operational performance, nonwoven fabric properties, and biological degradation performance are shown in Table 12.

EXAMPLE 64

A copolymer of butylenesuccinate/ethylenesuccinate=85/15 (mol %) having an MFR value of 30 g/10 min, a melting point of 102° C., and a crystallizing temperature of 52° C. was used as high melting point component polymer, and a poly(caprolactone) having an MFR value of 30 g/10 min, a melting point of 63° C., and a crystallizing temperature of 23° C. was used as low melting point component polymer. A master batch containing 15 wt % of a 1/1 in weight ratio mixture of talc/titanium oxide having a mean particle size of 1.0 μm was previously prepared as a polymer base for each of the high melting point and low melting point components. Each of the master batches was blended with the corresponding polymer so that crystallizing agent was to be added to the high melting point component in the amount of 0.6 wt %, and to the low melting point component in the amount of 3.0 wt %. Multileaf type composite filaments were melt spun in the same way as in Example 56, except that such a blend was used as raw material; that the spinning temperature was set at 150° C.; and that the mass out flow rate from each orificenozzle linear spinning velocity was set at 2.00 g/min. The filaments were quenched by a conventional quenching device, and were then drafted and attenuated and taken up by an air sucker at a drafting speed of 3800 m/min. Then, filaments were subjected to filament separation by a conventional filament-separating device and were gathered and laid up onto a moving screen conveyor so as to be formed into a nonwoven web comprised of filaments having a single filament fineness of 4.7 denier. The nonwoven web was subjected to bonding with heat and pressure by a bonding device with heat and pressure comprising an embossing roll, and a filament nonwoven fabric having a weight per unit area of 30 g/m$^2$ was obtained. Bonding with heat and pressure was carried out by using an embossing ing roll having a circular compression contact area of 0.68 mm$^2$ having an engraved pattern disposed so as to give a compression contact dot density of 16 dots/cm$^2$ and a compression area ratio of 7.6%, and a smooth surfaced metallic roll, at an operating temperature of 58° C. Operating conditions, operational performance, nonwoven fabric properties, and biological degradation performance are shown in Table 12.

As may be clearly seen from Tables 7, 8, 9 and 10, EXAMPLE 35, wherein multileaf type composite filament of the invention which incorporates a copolymer polyester of butylenesuccinate/ethylenesuccinate as low melting point component was used, exhibited good filament quenching efficiency, good spinnability and good filament-separating efficiency, and also exhibited satisfactory mechanical characteristics. The nonwoven fabric exhibited good biodegradability.

EXAMPLE 36, wherein multileaf type composite filament of the invention which incorporates polybutylenesuccinate as high melting point component and a copolymer polyester of butylenesuccinate/butyleneadipate as low melting point component was used, exhibited good filament quenching efficiency, good spinnability and good filament-separating efficiency, and also exhibited satisfactory mechanical performance. The nonwoven fabric exhibited good biodegradation capability.

EXAMPLE 37, wherein multileaf type composite filament of the invention which incorporates polybutylene succinate as high melting point component and a copolymer polyester of butylenesuccinate/butylenesebacate as low melting point component was used, exhibited good filament quenching efficiency, good spinnability and good filament-separating efficiency, and also exhibited satisfactory mechanical performance. The nonwoven fabric exhibited good biodegradation capability.

EXAMPLE 38, wherein multileaf type composite filament of the invention which uses a copolymer polyester of butylenesuccinate/ethylenesuccinate for both high melting point component and low melting point component was applied, exhibited good filament quenching efficiency, good spinnability and good filament-separating efficiency, and also exhibited satisfactory mechanical performance. The nonwoven fabric exhibited good biodegradability.

EXAMPLE 39, wherein multileaf type composite filament of the invention which uses a copolymer polyester of butylenesuccinate/butyleneadipate as high melting point component and a copolymer polyester of butylenesuccinate/ethylenesuccinate as low melting point component was applied, exhibited good filament quenching efficiency, good spinnability and good filament-separating efficiency, and also exhibited satisfactory mechanical performance. The nonwoven fabric exhibited good biodegradation capability.

EXAMPLE 40, wherein multileaf type composite filament of the invention which uses a copolymer polyester of butylenesuccinate/butylenesebacate as high melting point component and a copolymer polyester of butylenesuccinate/ethylenesuccinate as low melting point component was applied, exhibited good filament quenching efficiency, good spinnability and good filament-separating efficiency, and also exhibited satisfactory mechanical performance. The nonwoven fabric exhibited good biodegradation capability.

EXAMPLE 41, wherein multileaf type composite filament of the invention which uses poly(L-lactic acid) as high melting point component and a copolymer polyester of L-lactic acid/ε-caprolactone as low melting point component was applied, exhibited good filament quenching efficiency, good spinnability and good filament-separating efficiency, and also exhibited satisfactory mechanical performance. The nonwoven fabric exhibited good biodegradation capability.

EXAMPLE 42, wherein multileaf type composite filament of the invention which uses a copolymer polyester of L-lactic acid/D-lactic acid as high melting point component and a copolymer polyester of L-lactic acid/glycolic acid as low melting point component was applied, exhibited good filament quenching efficiency, good spinnability and good filament-separating efficiency, and also exhibited satisfactory mechanical performance, particularly in softness. The nonwoven fabric exhibited good biodegradation capability.

In EXAMPLE 43, the mole ratio of butylenesuccinate in the copolymer polyester of butylenesuccinate/ethylenesuccinate used as low melting point component was lower than that in EXAMPLE 35, but through the application of multileaf type composite filament of the invention, good performance was exhibited in respect of filament quenching efficiency, spinnability, and filament-separating efficiency. Also, good mechanical performance was exhobited. This nonwoven fabric was found highly biodegradable.

In EXAMPLE 44, the mole ratio of butylenesuccinate in the copolymer polyester of butylenesuccinate/ethylenesuccinate used as low melting point component was higher than that in EXAMPLE 35, but through the application of multileaf type composite filament of the invention, good performance was exhibited in respect of filament quenching efficiency, spinnability, and filament-separating efficiency. Also, good mechanical performance was exhibited. This nonwoven fabric was found highly biodegradable.

EXAMPLE 45, wherein polymers of higher viscosity than those in EXAMPLE 35 were used for both high melting point and low melting point components, but the application of multileaf composite filament of the invention resulted in good performance in spinnability, filament-separating efficiency, and mechanical performance, though filament quenching performance was less favorable. This nonwoven fabric was found highly biodegradable.

EXAMPLE 46, wherein polymers of lower viscosity than those in EXAMPLE 35 were used for both high melting point and low melting point components, but the application of multileaf composite filament of the invention resulted in good performance in filament quenching efficiency, spinnability, filament-separating efficiency, and mechanical performance. This nonwoven fabric was found highly biodegradable.

EXAMPLE 47, wherein the configuration of high melting point component was such that projections of the high melting point component were exposed high above the surface as shown in FIG. 4, but the application of the multileaf type of composite filament of the invention resulted in good performance in filament quenching efficiency, spinnability, and filament-separating efficiency.

Also, good mechanical performance was exhibited, though slightly less favorable in strength than EXAMPLE 35. This nonwoven fabric was found highly biodegradable.

In EXAMPLE 48, the number of high melting point component projections was smaller than in EXAMPLE 35, and accordingly the perimeter ratio of low melting point component was increased, that is, the exposed area of the low melting point component on the filament surface was larger. However, the application of the multileaf type of composite filament of the invention resulted in good performance in spinnability and filament-separating efficiency, though slightly less favorable in filament quenching efficiency. Also, good mechanical performance was exhibited. This nonwoven fabric was found highly biodegradable.

In EXAMPLE 49, the number of high melting point component projections was larger than in EXAMPLE 35, and accordingly the perimeter ratio of low melting point component was decreased, that is, the exposed area of the low melting point component on the filament surface was smaller. However, the application of the multileaf type of composite filament of the invention resulted in good performance in filament quenching efficiency, spinnability and filament-separating efficiency, and also in mechanical characteristics, though the biodegradability of the nonwoven fabric was slightly less favorable.

In EXAMPLE 50, the proportion of low melting point component was larger than in EXAMPLE 35, and accordingly the perimeter ratio of low melting point component was increased, that is, the exposed area of the low melting point component on the filament surface was larger. However, the application of the multileaf type of composite filament of the invention resulted in good performance in spinnability and filament-separating efficiency, though slightly less favorable in filament quenching efficiency as compared with EXAMPLE 35. Good performance was also exhibited in mechanical characteristics. The nonwoven fabric exhibited even higher biodegradability than EXAMPLE 35.

In EXAMPLE 51, the proportion of low melting point component was smaller than in EXAMPLE 35, and accordingly the perimeter ratio of low melting point component was smaller, that is, the exposed area of the low melting point component on the filament surface was smaller. However, the application of the multileaf type of composite filament of the invention resulted in good performance in filament quenching efficiency, spinnability, filament-separating efficiency, and mechanical characteristics, though slightly less favorable in biodegradability of nonwoven fabric as compared with EXAMPLE 35.

In EXAMPLE 52, the filament drafting speed was so low as to be inconsistent with the preferred speed range of the invention, and therefore the results were less favorable n filament quenching efficiency, spinnability, and filament-separating efficiency, and also in mechanical characteristics and dimensional stability of the nonwoven fabric obtained. However, this nonwoven fabric exhibited good biodegradability.

In EXAMPLE 53, a lower filament drafting speed than in EXAMPLE 53 was used. However, the application of the multileaf type of composite filament of the invention resulted in good performance in filament quenching efficiency, spinnability, filament-separating efficiency, and mechanical characteristics, though slightly less favorable in dimensional stability. The nonwoven fabric exhibited good biodegradability.

In EXAMPLE 54, the nonwoven web obtained in EXAMPLE 35 was thermocompression bonded by using an ultrasonic fusion boding apparatus. The resulting nonwoven fabric had good softness. Good performance was exhibited in filament quenching efficiency, spinnability, and filament-separating efficiency. Good mechanical performance was also exhibited. Further, the nonwoven fabric exhibited good biodegradability.

In EXAMPLE 55, the operating temperature at the thermocompression bonding stage was higher than that in EXAMPLE 35. However, the application of the multileaf type of composite filament of the invention resulted in good performance in filament quenching efficiency, spinnability, filament-separating efficiency, and mechanical characteristics, though slightly less favorable in the softness of the nonwoven fabric obtained. The nonwoven fabric exhibited good biodegradability.

Where a crystallizing agent was added, as in EXAMPLES 56–58, operational performance was found satisfactory with no problem involved in filament quenching and filament-separating efficiencies, as may be apparent from Tables 11 and 12. Further, the nonwoven fabric obtained had good strength characteristic suitable for practical use, had soft feel, and good biodegradability.

In EXAMPLE 59, equal amounts of crystallizing agent were added to both high melting point component and low melting point component. This resulted in slightly less favorable filament quenching efficiency. However, there was found no problem with operational performance.

In EXAMPLE 60, the total addition of crystallizing agent exceeded the preferred range of the invention. Therefore, the resulting nonwoven fabric was slightly less favorable in strength as compared with EXAMPLE 56, though there was found no problem with filament quenching and filament-separating efficiencies.

In EXAMPLES 61 and 62, good operational performance was witnessed with no problem with filament quenching and filament-separating efficiencies. Furthermore, the nonwoven fabrics obtained had strength characteristics suitable for practical use, and had good soft hand and good biodegradability. In EXAMPLE 61, the crystallizing agent used was talc only, and in EXAMPLE 62, the crystallizing agent used was calcium carbonate only. This, however, involved no problem with respect to filament quenching and filament-separating efficiencies. It was thus found that there was no difference in the efficiency of the crystallizing agents.

In EXAMPLE 63, wherein a material having a lower melting point was used as low melting point component. However, there was found no problem with respect to filament quenching and filament-separating efficiencies.

In EXAMPLE 64, a polymer having a melting point lower than that in EXAMPLE 63 was used for both components. It was found that the crystallizing agent provided good contribution so that no problem was involved with respect to filament quenching and filament-separating efficiencies.

COMPARATIVE EXAMPLES

Comparative Example 1

Single phase type filaments were melt spun by using a high melting point component alone which was identical with the one used in EXAMPLE 1, namely a poly (butylenesuccinate) having an MFR value of 40 g/10 min, a melting point of 114° C., and a crystallizing temperature of 75° C., under the same conditions as in EXAMPLE 1, except that a spinneret adapted to provide a single phase, circular type filament cross section was used. The filaments were quenched by a conventional quenching device, and were then drafted and attenuated and taken up by an air sucker at a drafting speed of 4600 m/min. Then, filaments were subjected to filament separation by a conventional filament-separating device and were filament-separated and laid up onto a moving screen conveyor so as to be formed into a nonwoven web comprised of filaments having a single filament fineness of 4.0 denier. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1 except that the operating temperature was set at 97° C. Operational performance, nonwoven fabric properties, and biological degradation performance are shown in Table 13.

Comparative Example 2

Single phase type filaments were melt spun by using a low melting point component alone which was identical with the one used in EXAMPLE 1, namely a copolymer polyester of butylenesuccinate/ethylenesuccinate=85/15 (mol %) having an MFR value of 30 g/10 min, a melting point of 102° C., and a crystallizing temperature of 52° C., under the same conditions as in EXAMPLE 1, except that a spinneret adapted to provide a single phase, circular type filament cross section was used, and a mass out flow rate from each orifice of 1.7 g/min was used. The filaments were quenched by a conventional quenching device, and were then drafted and attenuated and taken up by an air sucker at a drafting speed of 3800 m/min. Then, filaments were subjected to filament separation by a conventional filament-separating device and were filament-separatedand laid up onto a moving screen conveyor so as to be formed into a nonwoven web comprised of filaments having a single filament fineness of 4.0 denier. However, because of the fact that the copolymer polyester was used alone, the filaments spun had poor quenching efficiency and inter-filament contact occurred. Therefore, any nonwoven fabric could not be produced. Operational performance is shown in Table 13.

Comparative Example 3

Sheath-core type filaments were melt spun by using two components identical with those used in EXAMPLE 1, under the same conditions as in EXAMPLE 1, except that the core portion constitutes a high melting point component and the sheath portion constitutes a low melting point component, and that the compound ratio of the two components was 1/1 in weight ratio. The filaments were quenched by a conventional quenching device, and were then drafted and attenuated and taken up by an air sucker at a drafting speed of 4400 m/min. Then, filaments were subjected to filament separation by a conventional filament-separating device and were filament-separatedand laid up onto a moving screen conveyor so as to be formed into a nonwoven web comprised of filaments having a single filament fineness of 3.7 denier. Operational performance is shown in Table 13.

Comparative Example 4

A nonwoven fabric comprised of alternate arrangement type composite filaments was produced by using, as high melting point component, a non-biodegradable polyethyleneterephthalate having an inherent viscosity [η]=0.70 and a melting point of 255° C. and, as low melting point component, a non-biodegradable polypropylene having an MFR value of 50 g/10 min and a melting point of 160° C.

The polyethyleneterephthalate was melted by using a melt extruder at 290° C., and the polypropylene was melted by using a separate melt extruder at 230° C. The melted resin masses of the two components were introduced into a spinneret pack at 290° C., and were melt spun into alternate arrangement type composite filaments by using a spinneret at a mass out flow rate of 2.0/min and in a compound ratio of 1/1 in weight ratio. The filaments were quenched by a conventional quenching device, and were then drafted and attenuated and taken up by an air sucker at a drafting speed of 4500 m/min. Then, filaments were subjected to filament separation by a conventional filament-separating device and were filament-separatedand laid up onto a moving screen conveyor so as to be formed into a nonwoven web comprised of filaments having a single filament fineness of 4.0 denier. The nonwoven web was subjected to bonding with heat and pressure by a bonding device with heat and pressure comprising an embossing roll, and a biodegradable filament nonwoven fabric having a weight per unit area of 30 g/m$^2$ was obtained. Bonding with heat and pressure was carried out under the same conditions as in EXAMPLE 1, except that the operating temperature was set at 135° C. Operational performance, nonwoven fabric properties, and biological degradation performance are shown in Table 13.

As is clear from Table 13, in COMPARATIVE EXAMPLE 1, a high melting point component identical with the one used in EXAMPLE 1 was used, but the filament cross section was a single phase type circular section which was outside the scope of the invention. Therefore, the resulting filaments were extremely unfavorable in respect of biodegradation capability, though there was no problem with spinnability and filament-separating efficiency. As such, any such nonwoven fabric as is intended by the present invention could not be obtained.

In COMPARATIVE EXAMPLE 2, a low melting point component identical with the one used in EXAMPLE 1 was used, but the filament cross section was a single phase type circular section which was outside the scope of the invention. Therefore, the resulting filaments were unsatisfactory in respect of quenching efficiency, spinnability, and filament-separating efficiency, and any nonwoven fabric could not be obtained.

In COMPARATIVE EXAMPLE 3, materials identical with those in EXAMPLE 1 was used, but the filament cross section was a sheath-core type section which was outside the scope of the invention. As such, there occurred inter-filamentary adhesion, and in addition filament separation was unsatisfactory. Therefore, any nonwoven fabric could not be obtained.

In COMPARATIVE EXAMPLE 4, alternate arrangement type composite filaments were used but both high melting point component and low melting point component were composed of non-biodegradable resins. Therefore, the resulting nonwoven fabric lacked biodegradation capability.

TABLE 1

| | | | Example 1 | Example 2 | Example 3 | Example 4 | Example 5 | | Example 6 | | Example 7 *4 |
|---|---|---|---|---|---|---|---|---|---|---|---|
| Raw material (LMP component) | copolymer partner | — | ethylene-succinate | butylene-adipate | ethylene-succinate | ethylene-succinate | *1 component A blend | *2 component B copolymer | component A poly (butylene-succinate) | *3 component B blend | ethylene-succinate |
| | butylenesuccinate copolymer mole ratio | mol % | 85 | 80 | 70 | 90 | | | | | 85 |
| | melting point (Tm) | °C. | 102 | 105 | 82 | 106 | | | | | 102 |
| | MFR value | g/10 min | 30 | 25 | 30 | 30 | | | | | 30 |
| Filament configuration | filament cross section | — | alternate arrangement type | alternate arrangement type | alternate arrangement type | alternate arrangement type | alternate arrangement type | | alternate arrangement type | | alternate arrangement type |
| | No. of elements, each component | — | 6 | 6 | 6 | 6 | 6 | | 6 | | 6 |
| | compound ratio (HMP component/ LMP component) | wt ratio | 1/1 | 3/1 | 1/1 | 1/1 | 1/1 | | 1/1 | | 1/1 |
| | fineness single filament | denier | 4.0 | 4.1 | 4.5 | 3.9 | 4.0 | | 4.0 | | 3.5 |
| | HMP element | denier | 0.33 | 0.51 | 0.38 | 0.33 | 0.33 | | 0.33 | | 0.10 |
| | LMP element | denier | 0.33 | 0.17 | 0.38 | 0.33 | 0.33 | | 0.33 | | 0.10 |
| Manufacturing method | drafting speed | m/min | 4500 | 4400 | 4000 | 4600 | 4300 | | 4600 | | 3500 |
| | Bonding means | — | e.b. *5 | e.b. *5 | e.b. *5 | e.b. *5 | e.b. *5 | | e.b. *5 | | e.b. *5 |
| | with heat and pressure operating temperature | °C. | 95 | 98 | 75 | 99 | 95 | | 95 | | 95 |
| Operational performance | quenching effeciency | — | ○ | ○ | ○ | ○ | ○ | | ○ | | ◎ |
| | filament-separating efficiency | — | ○ | ○ | ○ | ○ | ○ | | ○ | | ◎ |
| Nonwoven fabric property | weight per unit area | $g/m^2$ | 30 | 30 | 30 | 30 | 30 | | 30 | | 30 |
| | strength | kg/5 cm width | 6.0 | 5.1 | 5.3 | 6.3 | 5.8 | | 6.3 | | 5.7 |
| | biodegradability | — | ○ | ○ | ○ | ○ | ○ | | ○ | | ○ |
| | softness | g | 6.3 | 6.9 | 7.5 | 6.1 | 7.4 | | 6.0 | | 9.9 |

*1 blend: poly(butylenesuccinate) = 80 wt %, butylenesuccinate/ethylenesuccinate (85/15 mol %) = 20 wt %
*2 copolyester: butylenesuccinate/ethylenesuccinate (85/15 mol %)
*3 blend: butylenesuccinate/ethylenesuccinate (85/15 mol %) = 80 wt %, poly(butylenesuccinate) = 20 wt %
*4 loaded with crystallizing agent
*5 e.b.: embossing roll

TABLE 2

| | | | Example 8 | Example 9 | Example 10 | Example 11 | Example 12 | Example 13 |
|---|---|---|---|---|---|---|---|---|
| Raw material (LMP component) | copolymer partner | — | ethylene-succinate | ethylene-succinate | ethylene-succinate | ethylene-succinate | ethylene-succinate | ethylene-succinate |
| | butylenesuccinate copolymer mole ratio | mol % | 85 | 85 | 85 | 85 | 85 | 85 |
| | melting point (Tm) | °C. | 102 | 102 | 102 | 102 | 102 | 102 |
| | MFR value | g/10 min | 30 | 30 | 30 | 30 | 30 | 30 |
| Filament configuration | filament cross section | — | alternate arrangement type | alternate arrangement type | alternate arrangement type | alternate arrangement type | alternate arrangement type | alternate arrangement type |
| | No. of elements, each component | — | 6 | 6 | 3 | 18 | 6 | 6 |
| | compound ratio (HMP component/ LMP component) | wt ratio | 1/1 | 1/1 | 1/1 | 1/1 | 1/3 | 3/1 |
| | fineness single filament | denier | 2.5 | 6.1 | 4.5 | 4.3 | 1.8 | 7.3 |
| | HMP element | denier | 0.21 | 0.51 | 0.75 | 0.12 | 0.08 | 0.91 |
| | LMP element | denier | 0.21 | 0.51 | 0.75 | 0.12 | 0.23 | 0.30 |
| Manufacturing method | drafting speed | m/min | 4300 | 4700 | 4000 | 4200 | 4000 | 4900 |
| | Bonding means | — | e.b. *1 | e.b. *1 | e.b. *1 | e.b. *1 | e.b. *1 | e.b. *1 |
| | with heat and pressure operating temperature | °C. | 95 | 95 | 95 | 95 | 95 | 95 |
| Operational performance | quenching effeciency | — | ○ | ○ | ○ | ○ | ○ | ○ |
| | filament-separating efficiency | — | ○ | ○ | ○ | ○ | ○ | ○ |
| Nonwoven fabric property | weight per unit area | g/m$^2$ | 30 | 30 | 30 | 30 | 30 | 30 |
| | strength | kg/5 cm width | 6.5 | 5.4 | 5.2 | 5.8 | 6.4 | 5.2 |
| | biodegradability | — | ○ | ○ | ○ | ○ | ○ | ○ |
| | softness | g | 5.1 | 10.1 | 6.8 | 5.4 | 4.8 | 14.6 |

Note:
*1 e.b.: embossing roll

TABLE 3

| | | | Example 14 | Example 15 | Example 16 | Example 17 | Example 18 |
|---|---|---|---|---|---|---|---|
| Raw material (LMP component) | copolymer partner | — | ethylene-succinate | ethylene-succinate | ethylene-succinate | ethylene-succinate | ethylene-succinate |
| | butylenesuccinate copolymer mole ratio | mol % | 85 | 85 | 85 | 85 | 85 |
| | melting point (Tm) | °C. | 102 | 102 | 102 | 102 | 102 |
| | MFR value | g/10 min | 30 | 30 | 30 | 30 | 30 |
| Filament configuration | filament cross section | — | alternate arrangement type | alternate arrangement type | alternate arrangement type | alternate arrangement type | alternate arrangement type |
| | No. of elements, each component | — | 6 | 6 | 6 | 6 | 6 |
| | compound ratio (HMP component/ LMP component) | wt ratio | 1/1 | 1/1 | 1/1 | 1/1 | 1/1 |
| | fineness single filament | denier | 9.0 | 4.0 | 4.0 | 4.0 | 4.0 |
| | HMP element | denier | 0.75 | 0.33 | 0.33 | 0.33 | 0.33 |
| | LMP element | denier | 0.75 | 0.33 | 0.33 | 0.33 | 0.33 |
| Manufacturing method | drafting speed | m/min | 2000 | 4500 | 4500 | 4500 | 4500 |
| | Bonding means | — | e.b. *1 | u.s.w. *2 | e.b. *1 | e.b. *1 | e.b. *1 |
| | with heat and pressure operating temperature | °C. | 95 | — | 102 | 95 | 95 |
| Operational performance | quenching effeciency | — | ○ | ○ | ○ | ○ | ○ |
| | filament-separating efficiency | — | ○ | ○ | ○ | ○ | ○ |
| Nonwoven fabric property | weight per unit area | g/m$^2$ | 30 | 30 | 30 | 10 | 100 |
| | strength | kg/5 cm width | 4.3 | 5.4 | 6.6 | 1.9 | 19.3 |
| | biodegradability | — | ○ | ○ | ○ | ○ | ○ |
| | softness | g | 16.1 | 4.2 | 11.4 | 1.6 | 24.5 |

Notes:
*1 e.b.: embossing roll
*2 u.s.w.: ultrasonic wave

TABLE 4

| | | | Example 19 | Example 20 | Example 21 | Example 22 | Example 23*1 | Example 24 | Example 25 |
|---|---|---|---|---|---|---|---|---|---|
| Raw material (LMP component) | copolymer partner | — | ethylene-succinate | butylene-adipate | ethylene-succinate | ethylene-succinate | ethylene-succinate | ethylene-succinate | ethylene-succinate |
| | butylenesuccinate copolymer mole ratio | mol % | 85 | 80 | 70 | 90 | 85 | 85 | 85 |
| | melting point (Tm) | °C. | 102 | 94 | 82 | 106 | 102 | 102 | 102 |
| Filament configuration | filament cross section | — | annularly alternate arrangement type | annularly alternate arrangement type | annularly alternate arrangement type | annularly alternate arrangement type | annularly alternate arrangement type | annularly alternate arrangement type | annularly alternate arrangement type |
| | No. of elements, each component | — | 6 | 6 | 6 | 6 | 18 | 3 | 18 |
| | compound ratio (HMP component/ LMP component) | wt ratio | 1/1 | 3/1 | 3/1 | 1/2 | 1/1 | 1/1 | 1/1 |
| | hollowness ratio | % | 20.3 | 21.2 | 22.6 | 20.5 | 15.6 | 20.0 | 16.8 |
| | fineness single filament | denier | 4.0 | 4.1 | 5.1 | 3.9 | 3.5 | 4.1 | 4.3 |
| | HMP element | denier | 0.33 | 0.51 | 0.64 | 0.22 | 0.10 | 0.68 | 0.12 |
| | LMP element | denier | 0.33 | 0.17 | 0.21 | 0.43 | 0.10 | 0.68 | 0.12 |
| Manufacturing method | drafting speed | m/min | 4050 | 4000 | 3200 | 4200 | 3500 | 4000 | 3750 |
| | Bonding means | — | e.b. *2 | e.b. *2 | e.b. *2 | e.b. *2 | e.b. *2 | e.b. *2 | e.b. *2 |
| | Bonding with heat and pressure operating temperature | °C. | 95 | 87 | 75 | 99 | 95 | 95 | 95 |
| Operational performance | quenching effeciency | — | ○ | ○ | ○ | ○ | ◎ | ○ | ○ |
| | filament-separating efficiency | — | ○ | ○ | ○ | ○ | ◎ | ○ | ○ |
| Nonwoven fabric property | strength | kg/5 cm width | 5.8 | 4.7 | 4.3 | 6.3 | 5.6 | 5.6 | 5.6 |
| | biodegradability | — | ○ | ○ | ○ | ○ | ○ | ○ | ○ |
| | softness | g | 5.8 | 6.1 | 6.4 | 5.6 | 6.1 | 6.9 | 4.2 |

Notes:
*1 loaded with crystallizing agent
*2 e.b.: embossing roll

TABLE 5

| | | | Example 26 | Example 27 | Example 28 | Example 29 | Example 30 | Example 31 |
|---|---|---|---|---|---|---|---|---|
| Raw material (LMP component) | copolymer partner | — | ethylene-succinate | ethylene-succinate | ethylene-succinate | ethylene-succinate | ethylene-succinate | ethylene-succinate |
| | butylenesuccinate copolymer mole ratio | mol % | 85 | 85 | 85 | 85 | 85 | 85 |
| | melting point (Tm) | °C. | 102 | 102 | 102 | 102 | 102 | 102 |
| Filament configuration | filament cross section | — | annularly alternate arrangement type | annularly alternate arrangement type | annularly alternate arrangement type | annularly alternate arrangement type | annularly alternate arrangement type | annularly alternate arrangement type |
| | No. of elements, each component | — | 6 | 6 | 6 | 6 | 6 | 6 |
| | compound ratio (HMP component/ LMP component) | wt ratio | 1/3 | 3/1 | 1/1 | 1/1 | 1/1 | 1/1 |
| | hollowness ratio | % | 18.2 | 23.5 | 5.0 | 30.0 | 19.6 | 20.3 |
| | fineness single filament | denier | 1.8 | 7.0 | 1.7 | 9.8 | 8.1 | 4.0 |
| | HMP element | denier | 0.08 | 0.88 | 0.14 | 0.82 | 0.68 | 0.33 |
| | LMP element | denier | 0.23 | 0.29 | 0.14 | 0.82 | 0.68 | 0.33 |
| Manufacturing method | drafting speed | m/min | 3600 | 4500 | 3800 | 3200 | 2000 | 4050 |
| | Bonding means | — | e.b. *1 | e.b. *1 | e.b. *1 | e.b. *1 | e.b. *1 | u.s.w. *2 |
| | Bonding with heat and pressure operating temperature | °C. | 95 | 95 | 95 | 95 | 95 | — |
| Operational performance | quenching effeciency | — | ○ | ○ | ○ | ○ | ○ | ○ |
| | filament-separating efficiency | — | ○ | ○ | ○ | ○ | ○~Δ | ○ |
| Nonwoven fabric property | strength | kg/5 cm width | 6.1 | 4.9 | 6.3 | 4.1 | 5.3 | 5.2 |
| | biodegradability | — | ○ | ○ | ○ | ○ | ○ | ○ |
| | softness | g | 3.8 | 10.2 | 3.5 | 18.5 | 15.1 | 3.5 |

Notes:
*1 e.b.: embossing roll
*2 u.s.w.: ultrasonic wave

TABLE 6

| | | | | Example 32 | Example 33 | Example 34 |
|---|---|---|---|---|---|---|
| Raw material (LMP component) | copolymer partner | | — | ethylene-succinate | ethylene-succinate | ethylene-succinate |
| | butylenesuccinate copolymer mole ratio | | mol % | 85 | 85 | 85 |
| | melting point (Tm) | | °C. | 102 | 102 | 102 |
| Filament configuration | filament cross section | | — | annularly alternate arrangement type | annularly alternate arrangement type | annularly alternate arrangement type |
| | No. of elements, each component | | — | 6 | 6 | 6 |
| | compound ratio (HMP component/ LMP component) | | wt ratio | 1/1 | 1/1 | 1/1 |
| | hollowness ratio | | % | 20.3 | 20.3 | 20.3 |
| | fineness | single filament | denier | 4.0 | 4.0 | 4.0 |
| | | HMP element | denier | 0.33 | 0.33 | 0.33 |
| | | LMP element | denier | 0.33 | 0.33 | 0.33 |
| Manufacturing method | drafting speed | | m/min | 4050 | 4050 | 4050 |
| | Bonding with heat and pressure | means | — | e.b. *1 | e.b. *1 | e.b. *1 |
| | | operating temperature | °C. | 67 | 77 | 102 |
| Operational performance | quenching effeciency | | — | ○ | ○ | ○ |
| | filament-separating efficiency | | — | ○ | ○ | ○ |
| Nonwoven fabric property | strength | | kg/5 cm width | 2.1 | 3.2 | 5.7 |
| | biodegradability | | — | ○ | ○ | ○ |
| | softness | | g | 1.8 | 4.1 | 21.9 |

Note:
*1 e.b.: embossing roll

TABLE 7

| | | | | | Example 35 | Example 36 | Example 37 | Example 38 | Example 39 | Example 40 |
|---|---|---|---|---|---|---|---|---|---|---|
| Raw material | HMP component | copolymer partner | | — | — | — | — | ethylene-succinate | butylene-adipate | butylene-sebacate |
| | | butylenesuccinate copolymer mole ratio | | mol % | 100 | 100 | 100 | 80 | 90 | 90 |
| | | MFR value | | g/10 min | 20 | 20 | 20 | 20 | 20 | 20 |
| | LMP component | copolymer partner | | — | ethylene-succinate | butylene-adipate | butylene-sebacate | ethylene-succinate | ethylene-succinate | ethylene-succinate |
| | | butylenesuccinate copolymer mole ratio | | mol % | 85 | 80 | 85 | 70 | 85 | 85 |
| | | melting point (Tm) | | °C. | 102 | 105 | 105 | 90 | 102 | 102 |
| | | MFR value | | g/10 min | 30 | 30 | 30 | 30 | 30 | 30 |
| Filament configuration | | filament cross section | | — | multileaf type | multileaf type | multileaf type | multileaf type | multileaf type | multileaf type |
| | | HMP component arrange form | | Fig. No. | 3 | 3 | 3 | 3 | 3 | 3 |
| | | perimeter ratio (HMP component/LMP component) | | — | 73/27 | 73/27 | 72/28 | 71/29 | 72/28 | 71/29 |
| | | HMP component projections | | — | 6 | 6 | 6 | 6 | 6 | 6 |
| | | compound ratio (HMP component/LMP component) | | wt ratio | 1/1 | 1/1 | 1/1 | 1/1 | 1/1 | 1/1 |
| | | fineness | single filament | denier | 4.1 | 4.4 | 4.5 | 4.6 | 4.9 | 5.0 |
| | | | HMP element | denier | 0.34 | 0.37 | 0.38 | 0.39 | 0.41 | 0.42 |
| | | | LMP element | denier | 2.0 | 2.2 | 2.3 | 2.3 | 2.4 | 2.5 |
| Manufacturing method | | drafting speed | | m/min | 4200 | 3900 | 3800 | 3700 | 3500 | 3400 |
| | | BHP *1 | means | — | e.b. *2 | e.b. *2 | e.b. *2 | e.b. *2 | e.b. *2 | e.b. *2 |
| | | | operating temperature | °C. | 95 | 98 | 98 | 83 | 95 | 95 |
| Operational performance | | quenching efficiency | | — | ○ | ○ | ○ | ○ | ○ | ○ |
| | | filament-separating efficiency | | — | ○ | ○ | ○ | ○ | ○ | ○ |
| Nonwoven fabric property | | strength | | kg/5 cm width | 5.8 | 4.9 | 4.7 | 4.2 | 4.6 | 4.5 |
| | | biodegradability | | — | ○ | ○ | ○ | ○ | ○ | ○ |
| | | softness | | g | 9.7 | 7.5 | 7.3 | 9.2 | 10.1 | 10.8 |

Notes:
*1 BHP: Bonding with heat and pressure
*2 e.b.: embossing roll

TABLE 8

| | | | | Example 41 *1 | Example 42 *1 | Example 43 | Example 44 | Example 45 | Example 46 |
|---|---|---|---|---|---|---|---|---|---|
| Raw material | HMP component | copolymer partner | — | — | D-lactic acid | — | — | — | — |
| | | butylenesuccinate copolymer mole ratio | mol % | 100 | 90 | 100 | 100 | 100 | 100 |
| | | MFR value | g/10 min | 12 | 20 | 20 | 20 | 5 | 50 |
| | LMP component | copolymer partner | — | ε-caprolactone | glycolic acid | ethylene-succinate | ethylene-succinate | ethylene-succinate | ethylene-succinate |
| | | butylenesuccinate copolymer mole ratio | mol % | 85 | 80 | 70 | 90 | 85 | 85 |
| | | melting point (Tm) | °C. | 154 | 111 | 92 | 108 | 102 | 102 |
| | | MFR value | g/10 min | 35 | 20 | 30 | 30 | 10 | 60 |
| Filament configuration | | filament cross section | — | multileaf type | multileaf type | multileaf type | multileaf type | multileaf type | multileaf type |
| | | HMP component arrange form | Fig. No. | 3 | 3 | 3 | 3 | 3 | 3 |
| | | perimeter ratio (HMP component/LMP component) | — | 73/27 | not measured | 73/27 | 73/27 | 69/31 | 77/23 |
| | | HMP component projections | — | 6 | 6 | 6 | 6 | 6 | 6 |
| | | compound ratio (HMP component/LMP component) | wt ratio | 1/1 | 1/1 | 1/1 | 1/1 | 1/1 | 1/1 |
| | | fineness single filament | denier | 4.5 | 3.5 | 4.4 | 4.0 | 4.9 | 3.8 |
| | | HMP element | denier | 0.38 | 0.29 | 0.37 | 0.34 | 0.41 | 0.32 |
| | | LMP element | denier | 2.3 | 1.75 | 2.2 | 2.0 | 2.5 | 1.9 |
| Manufacturing method | | drafting speed | m/min | 3800 | 3500 | 3900 | 4200 | 3500 | 4500 |
| | | BHP *1 means | — | e.b. *3 | e.b. *3 | e.b. *3 | e.b. *3 | e.b. *3 | e.b. *3 |
| | | operating temperature | °C. | 147 | 106 | 85 | 101 | 95 | 95 |
| Operational performance | | quenching efficiency | — | ○ | ○ | ○ | ○ | Δ | ○ |
| | | filament-separating efficiency | — | ○ | ○ | ○ | ○ | ○ | ○ |
| Nonwoven fabric property | | strength | kg/5 cm width | 5.6 | 4.2 | 5.2 | 5.9 | 6.0 | 5.2 |
| | | biodegradability | — | ○ | ○ | ○ | ○ | ○ | ○ |
| | | softness | g | 11.2 | 15.0 | 8.1 | 9.9 | 12.1 | 6.4 |

Notes:
*1 In Examples 41, 42, L-lactic acid was used, in place of butylenesuccinate, as main repeating units of HMP and LMP components.
*2 BHP: Bonding with heat and pressure
*3 e.b.: embossing roll

TABLE 9

| | | | | Example 47 | Example 48 | Example 49 |
|---|---|---|---|---|---|---|
| Raw material | HMP component | copolymer partner | — | — | — | — |
| | | butylenesuccinate copolymer mole ratio | mol % | 100 | 100 | 100 |
| | | MFR value | g/10 min | 20 | 20 | 20 |
| | LMP component | copolymer partner | — | ethylene-succinate | ethylene-succinate | ethylene-succinate |
| | | butylenesuccinate copolymer mole ratio | mol % | 85 | 85 | 85 |
| | | melting point (Tm) | °C. | 102 | 102 | 102 |
| | | MFR value | g/10 min | 30 | 30 | 30 |
| Filament configuration | | filament cross section | — | multileaf type | multileaf type | multileaf type |
| | | HMP component arrange form | Fig. No. | 4 | 3 | 3 |
| | | perimeter ratio (HMP component/LMP component) | — | 68/32 | 63/37 | 88/12 |
| | | HMP component projections | — | 6 | 4 | 10 |
| | | compound ratio (HMP component/LMP component) | wt ratio | 1/1 | 1/1 | 1/1 |
| | | fineness single filament | denier | 4.0 | 4.3 | 4.0 |
| | | HMP element | denier | 0.34 | 0.53 | 0.20 |
| | | LMP element | denier | 2.0 | 2.1 | 2.0 |
| Manufacturing method | | drafting speed | m/min | 3800 | 4000 | 4300 |
| | | BHP *1 means | — | e.b. *2 | e.b. *2 | e.b. *2 |
| | | operating temperature | °C. | 95 | 95 | 95 |
| Operational performance | | quenching efficiency | — | ○ | Δ | ○ |
| | | filament-separating efficiency | — | ○ | ○ | ○ |
| Nonwoven fabric property | | strength | kg/5 cm width | 3.9 | 5.6 | 5.7 |
| | | biodegradability | — | ○ | ○ | ○ |
| | | softness | g | 9.8 | 9.8 | 9.6 |

Notes:
*1 BHP: Bonding with heat and pressure
*2 e.b.: embossing roll

TABLE 10

| | | | | Example 50 | Example 51 | Example 52 | Example 53 | Example 54 | Example 55 |
|---|---|---|---|---|---|---|---|---|---|
| Raw material | HMP component | copolymer partner | — | — | — | — | — | — | — |
| | | butylenesuccinate copolymer mole ratio | mol % | 100 | 100 | 100 | 100 | 100 | 100 |
| | | MFR value | g/10 min | 20 | 20 | 20 | 20 | 20 | 20 |
| | LMP component | copolymer partner | — | ethylene-succinate | ethylene-succinate | ethylene-succinate | ethylene-succinate | ethylene-succinate | ethylene-succinate |
| | | butylenesuccinate copolymer mole ratio | mol % | 85 | 85 | 85 | 85 | 85 | 85 |
| | | melting point (Tm) | °C. | 102 | 102 | 102 | 102 | 102 | 102 |
| | | MFR value | g/10 min | 30 | 30 | 30 | 30 | 30 | 30 |
| Filament configuration | | filament cross section | — | multileaf type | multileaf type | multileaf type | multileaf type | multileaf type | multileaf type |
| | | HMP component arrange form | Fig. No. | 3 | 3 | 3 | 3 | 3 | 3 |
| | | perimeter ratio (HMP component/LMP component) | — | 48/52 | 85/15 | 73/27 | 73/27 | 73/27 | 73/27 |
| | | HMP component projections | — | 6 | 6 | 6 | 6 | 6 | 6 |
| | | compound ratio (HMP component/LMP component) | wt ratio | 1/3 | 3/1 | 1/1 | 1/1 | 1/1 | 1/1 |
| | | fineness single filament | denier | 4.5 | 4.1 | 9.5 | 8.6 | 4.1 | 4.1 |
| | | HMP element | denier | 0.19 | 0.52 | 0.79 | 0.72 | 0.34 | 0.34 |
| | | LMP element | denier | 3.4 | 1.0 | 4.8 | 4.3 | 2.0 | 2.0 |
| Manufacturing method | | drafting speed | m/min | 4000 | 4400 | 1800 | 2000 | 4200 | 4200 |
| | | BHP *1 means | — | e.b. *2 | e.b. *2 | e.b. *2 | e.b. *2 | u.s.w. *3 | e.b. *2 |
| | | operating temperature | °C. | 95 | 95 | 95 | 95 | — | 98 |
| Operational performance | | quenching efficiency | — | Δ | ○ | Δ | Δ | ○ | ○ |
| | | filament-separating efficiency | — | ○ | ○ | Δ | ○ | ○ | ○ |
| Nonwoven fabric property | | strength | kg/5 cm width | 5.0 | 6.0 | 3.2 | 5.9 | 5.2 | 6.2 |
| | | biodegradability | — | ○ | ○ | ○ | ○ | ○ | ○ |
| | | softness | g | 6.1 | 11.0 | 15.3 | 10.5 | 8.5 | 17.0 |

Notes:
*1 BHP: Bonding with heat and pressure
*2 e.b.: embossing roll
*3 u.s.w.: ultrasonic wave

TABLE 11

| | | | Example 56 | Example 57 | Example 58 | Example 59 | Example 60 |
|---|---|---|---|---|---|---|---|
| HMP component | polymer type | — | poly (butylene-succinate) | poly (butylene-succinate) | poly (butylene-succinate) | poly (butylene-succinate) | poly (butylene-succinate) |
| | melting point | °C. | 114 | 114 | 114 | 114 | 114 |
| | crystallizing temperature | °C. | 75 | 75 | 75 | 75 | 75 |
| | crystallizing agent kind | — | talc/titanium oxide (1/1) | talc/titanium oxide (1/1) | — | talc/titanium oxide (1/1) | talc/titanium oxide (1/1) |
| | addition | wt % | 0.2 | 0.8 | 0 | 1.0 | 2.4 |
| LMP component | polymer type | — | BS/ES *1 | BS/ES *1 | BS/ES *1 | BS/ES *1 | BS/ES *1 |
| | melting point | °C. | 102 | 102 | 102 | 102 | 102 |
| | crystallizing temperature | °C. | 52 | 52 | 52 | 52 | 52 |
| | crystallizing agent kind | — | talc/titanium oxide (1/1) | talc/titanium oxide (1/1) | talc/titanium oxide (1/1) | talc/titanium oxide (1/1) | talc/titanium oxide (1/1) |
| | addition | wt % | 1.0 | 2.0 | 0.4 | 1.0 | 3.6 |
| Crystallizing agent, Total | | wt % | 1.2 | 2.8 | 0.4 | 2.0 | 6.0 |
| Filament cross section (HMP component arrange form) | | | multileaf type (FIG. 3) | multileaf type (FIG. 3) | multileaf type (FIG. 3) | multileaf type (FIG. 3) | multileaf type (FIG. 3) |
| Finenss | single filament | denier | 3.5 | 3.5 | 3.5 | 3.5 | 3.5 |
| | HMP component | denier | 0.29 | 0.29 | 0.29 | 0.29 | 0.29 |
| | LMP component | denier | 1.75 | 1.75 | 1.75 | 1.75 | 1.75 |
| Operational performance | quenching efficiency | — | ◎ | ◎ | ◎ | ○ | ◎ |
| | filament-separating efficiency | — | ◎ | ◎ | ◎ | ◎ | ◎ |
| Nonwoven fabric property | Tensile strength | kg/cm width | 5.8 | 5.7 | 6.0 | 5.6 | 4.2 |
| | Tensile elongation | % | 61 | 60 | 61 | 58 | 52 |
| | softness | g | 9.9 | 10.2 | 9.9 | 10.2 | 9.9 |
| | biodegradability | — | ○ | ○ | ○ | ○ | O |

Note:
*1 BS/ES: butylensuccinate/ethylenesccinate

TABLE 12

| | | | Example 61 | Example 62 | Example 63 | Example 64 |
|---|---|---|---|---|---|---|
| HMP component | polymer type | — | poly (butylene-succinate) | poly (butylene-succinate) | poly (butylene-succinate) | BS/ES *1 |
| | melting point | °C. | 114 | 114 | 114 | 102 |
| | crystallizing temperature | °C. | 75 | 75 | 75 | 52 |
| | crystallizing agent kind | — | talc | calcium carbonate | talc/titanium oxide (1/1) | talc/titanium oxide (1/1) |
| | addition | wt % | 0.2 | 0.4 | 0.4 | 0.6 |
| LMP component | polymer type | — | BS/ES *1 | BS/ES *1 | BS/BA *2 | poly(caprolactone) |
| | melting point | °C. | 102 | 102 | 94 | 63 |
| | crystallizing temperature | °C. | 52 | 52 | 48 | 23 |
| | crystallizing agent kind | — | talc | calcium carbonate | talc/titanium oxide (1/1) | talc/titanium oxide (1/1) |
| | addition | wt % | 0.5 | 0.8 | 3.0 | 3.0 |
| Crystallizing agent, Total | | wt % | 0.7 | 1.2 | 3.4 | 3.6 |
| Filament cross section (HMP component arrange form) | | | multileaf type (FIG. 3) | multileaf type (FIG. 3) | multileaf type (FIG. 3) | multileaf type (FIG. 3) |
| Finenss | single filament | denier | 3.5 | 3.5 | 3.5 | 4.7 |
| | HMP component | denier | 0.29 | 0.29 | 0.10 | 0.47 |
| | LMP component | denier | 1.75 | 1.75 | 1.10 | 1.89 |
| Operational performance | quenching efficiency | — | ◎ | ◎ | ◎ | ◎ |
| | filament-separating efficiency | — | ◎ | ◎ | ◎ | ◎ |
| Nonwoven fabric property | Tensile strength | kg/cm width | 5.9 | 5.9 | 5.2 | 4.5 |
| | Tensile elongation | % | 61 | 60 | 54 | 53 |
| | softness | g | 9.9 | 11.1 | 9.3 | 9.0 |
| | biodegradability | — | ○ | ○ | ○ | O |

Notes:
*1 BS/ES: butylensuccinate/ethylenesccinate
*2 BS/BA: butylensuccinate/butyleneadipate

TABLE 13

| | | | Comparative Example 1 | Comparative Example 2 | Comparative Example 3 | | Comparative Example 4 | |
|---|---|---|---|---|---|---|---|---|
| Raw material | polymer partner | — | — | ethylene-succinate | core — | sheath ethylene-succinate | HMP component PET *1 | LMP component PP *2 |
| | butylenesuccinate copolymer mole ratio | mol % | 100 | 85 | 100 | 85 | 100 | 100 |
| | melting point (Tm) | °C. | 114 | 102 | 114 | 102 | 255 | 160 |
| | MFR value | g/10 min | 40 | 30 | 40 | 30 | 0.7 *3 | 50 |
| Filament configuration | filament cross section | — | single phase, circular | single phase, circular | sheath-core type | | alternate arrange type | |
| | compound ratio (HMP component/ LMP component) | wt ratio | — | — | 1/1 | | 1/1 | |
| | single filament fineness | denier | 4.0 | 4.0 | 3.7 | | 4.0 | |
| Manufacturing method | drafting speed | m/min | 4600 | 3800 | 4400 | | 4500 | |
| | bonding means | — | e.b. *4 | — | — | | e.b. *4 | |
| | with heat and pressure operating temperature | °C. | 97 | — | — | | 135 | |
| Operational performance | quenching efficiency | — | Δ | X | X | | ○ | |
| | filament-separating efficiency | — | ○ | X | X | | ○ | |
| Nonwoven fabric property | strength | kg/5 cm width | 6.5 | — | — | | 7.3 | |
| | biodegradability | — | X | — | — | | X | |
| | softness | g | 5.3 | — | — | | 19.8 | |

Notes:
*1 PET: poly(ethyleneterephthalate)
*2 PP: polypropylene
*3 inherent viscosity
*4 e.b.: embossing roll

What is claimed is:

1. A biodegradable filament nonwoven fabric comprising a nonwoven web made up of filaments, each filament consisting of a high melting point component composed of a first biodegradable aliphatic polyester and a low melting point component composed of a second biodegradable aliphatic polyester with a melting point lower than that of the high melting point component, the nonwoven web processed to a predetermined nonwoven fabric configuration, at least one of the high melting point component and the low melting point component being arranged in a plurality of divisions in the cross section of the filament, both the high melting point component and the low melting point component extending continuously in the axial direction of the filament, the both components being exposed on the surface of the filament.

2. A biodegradable filament nonwoven fabric as set forth in claim 1, wherein the high melting point component and the low melting point component occupy predetermined divisional areas at alternate intervals within the cross section of the filament, each divisional area extending from the center of the filament cross-section to the circumference thereof, the high melting point component and the low melting point component being each arranged in equally divided condition.

3. A biodegradable filament nonwoven fabric as set forth in claim 1, wherein the filament has a hollow portion, and wherein the high melting point component and the low melting point component occupy predetermined divisional areas at alternate intervals within the cross section of the filament, each divisional area extending from the hollow portion to the circumference of the cross section, the high melting point component and the low melting point component being each arranged in equally divided condition, and wherein both the high melting point component and the low melting point component are exposed to the hollow portion.

4. A biodegradable filament nonwoven fabric as set forth in claim 1, wherein the low melting point component defines a center portion in the cross section of the filament, and wherein the high melting point component consists of a plurality of independent projections arranged along the circumferential edge of the low melting point component.

5. A biodegradable filament nonwoven fabric as set forth in claim 1, wherein the high melting point component and/or the low melting point component consist of a polymer or polymers selected from the group consisting of poly (ethylenesuccinate), poly(butylenesuccinate), poly (butyleneadipate), poly(butylenesebacate), poly(lactic acid), and copolymerized polyesters composed of their repeating units.

6. A biodegradable filament nonwoven fabric as set forth in claim 2, wherein the high melting point component is composed of poly(butylenesuccinate) and the low melting point component is composed of a copolymerized polyester comprising butylenesuccinate as a main repeating unit in a proportion of from 70 to 90 mol % relative to the moles of total repeating units in the low melting point component polymer.

7. A biodegradable filament nonwoven fabric as set forth in claim 6, wherein the low melting point component comprises a copolymer polyester in which butylenesuccinate is copolymerized with ethylenesuccinate or butyleneadipate.

8. A biodegradable filament nonwoven fabric as set forth in claim 3, wherein the high melting point component is composed of poly(butylenesuccinate) and the low melting point component is composed of a copolymerized polyester comprising butylenesuccinate as a main repeating unit in a proportion of from 70 to 90 mol % relative to the moles of total repeating units in the low melting point component polymer.

9. A biodegradable filament nonwoven fabric as set forth in claim 8, wherein the low melting point component comprises a copolymerized polyester in which butylene succinate is copolymerized with ethylenesuccinate or butyleneadipate.

10. A biodegradable filament nonwoven fabric as set forth in claim 4, wherein high melting point component and the low melting point component are polymers including butylenesuccinate as a main repeating unit, the high melting point component being composed of a poly (butylenesuccinate) or a copolymerized polyester including butylenesuccinate in a proportion of not less than 80 mol % relative to the moles of total repeating units in the high melting point component polymer, the low melting point component being composed of a copolymerized polyester including butylenesuccinate in a proportion of from 70 to 90 mol % relative to the moles of total repeating units in the low melting point component polymer.

11. A biodegradable filament nonwoven fabric as set forth in claim 10, wherein both the high melting point component and the low melting point component, or only the low melting point component comprises a copolymerized polyester in which butylenesuccinate is copolymerized with one of ethylenesuccinate, butyleneadipate, and butylenesebacate.

12. A biodegradable filament nonwoven fabric as set forth in claim 1, wherein the high melting point component and/or the low melting point component comprise a blend of two or more polymers selected from the group consisting of poly (ethylenesuccinate), poly(butylenesuccinate), poly (butyleneadipate), poly(butylenesebacate), poly(lactic acid), and copolymerized polyesters composed of repeating units of these polymers.

13. A biodegradable filament nonwoven fabric as set forth in claim 12, wherein the blend ratio of the one polymer to be blended to the other is from 10/90 to 90/10 in weight.

14. A biodegradable filament nonwoven fabric as set forth in claim 1, wherein at least the low melting point component of the constituents of the filament is loaded with a crystallizing agent.

15. A biodegradable filament nonwoven fabric as set forth in claim 14, wherein the low melting point component and, when required, the high melting point component are loaded with the crystallizing agent, and wherein assuming that where the crystallizing agent is added to the high melting point component, the amount of that addition is QA (wt %) ($0 \leqq QA$), and that the amount of the crystallizing agent added to the low melting point component is QB (wt %) ($0 < QB$), the crystallizing agent loadings satisfy the following equations (1) and (2):

$$[(\Delta TA+\Delta TB)/100]-2/3 \leqq QA+QB \leqq [(\Delta TA+\Delta TB)/100]+4 \quad (1)$$

$$QA \leqq QB \quad (2)$$

where, $\Delta TA$=(melting point (°C.) of high melting point component)−(crystallizing temperature (°C.) of high melting point component)$\geqq$35;

$\Delta TB$=(melting point (°C.) of low melting point component)−(crystallization temperature (°C.) of low melting point component)$\geqq$35.

16. A biodegradable filament nonwoven fabric as set forth in claim 14, wherein the crystallizing agent is talc or titanium oxide, or a mixture thereof.

17. A biodegradable filament nonwoven fabric as set forth in claim 2, wherein the high melting point component and the low melting point component are each arranged in such a condition as divided into 3 to 20 elements within the cross section of the filament; wherein individual elements of the high melting point and low melting point components have a fineness of from 0.05 to 1.0 denier; and wherein a single filament comprised of the high melting point and low melting point components has a fineness of from 1.5 to 10 denier.

18. A biodegradable filament nonwoven fabric as set forth in claim 3, wherein the high melting point component and the low melting point component are each arranged in such a condition as divided into 3 to 20 elements within the cross section of the filament; wherein individual elements of the high melting point and low melting point components have a fineness of from 0.05 to 1.0 denier; and wherein a single filament comprised of the high melting point and low melting point components has a fineness of from 1.5 to 10 denier.

19. A biodegradable filament nonwoven fabric as set forth in claim 3, wherein assuming that in the cross section of the filament the diameter of the filament is (A) and the diameter of the hollow portion is (a), the hollowness ratio expressed by the following relation is from 5 to 30%:

$(a^2/A^2)\times 100$ (%).

20. A biodegradable filament nonwoven fabric as set forth in claim 4, wherein the number of individually independent projections of the high melting point component is from 4 to 10; wherein each has a fineness of from 0.05 to 2 denier; and wherein a single filament comprised of the high melting point and low melting point components has a fineness of from 1.5 to 10 denier.

21. A biodegradable filament nonwoven fabric as set forth in claim 1, wherein the weight per unit area of the nonwoven fabric is from 10 to 150 $g/m^2$.

22. A biodegradable filament nonwoven fabric as set forth in claim 1, wherein the nonwoven web is partially bonded with heat and pressure to have a predetermined form.

23. A biodegradable filament nonwoven fabric as set forth in claim 22, wherein the ratio of the bonded area with heat and pressure to the entire area of the nonwoven fabric is from 2 to 30%.

24. A biodegradable filament nonwoven fabric as set forth in claim 2, wherein the nonwoven web is partially bonded with heat and pressure to have a predetermined form, said partially bonded portion of the nonwoven web comprising portions of the low melting point component bonded to each other and portions of the high melting point component not bonded to each other.

25. A biodegradable filament nonwoven fabric as set forth in claim 3, wherein the nonwoven web is partially bonded with heat and pressure to have a predetermined form, said partially bonded portion of the nonwoven web comprising portions of the low melting point component bonded to each other and portions of the high melting point component not bonded to each other.

26. A biodegradable filament nonwoven fabric as set forth in claim 4, wherein the nonwoven web is partially bonded to have a predetermined form, said partially bonded nonwoven web comprising portions of the low melting point component and portions of the high melting point component, said portions of the high melting point component being not bonded to each other but being bonded to said portions of the low melting point component.

27. A method of manufacturing a biodegradable filament nonwoven fabric which comprises melt-spinning filaments, each filament being comprised of a high melting point component composed of a first aliphatic polyester having biodegradability and a low melting point component composed of a second aliphatic polyester having biodegradability and a melting point lower than that of the high melting point component, arranging the high melting point component and the low melting point component within a cross section of the filament in such a way that at least one of the two components is arranged in a plurality of divisions, while allowing both the high melting point component and the low melting point component to extend continuously in the axial direction of the filament and to be exposed on the surface of the filament, then drafting and attenuating the filaments, processing the filaments into a nonwoven web, and then processing the nonwoven web into a nonwoven fabric having a predetermined form.

28. A method of manufacturing a biodegradable filament nonwoven fabric as set forth in claim 27, wherein the high melting point component and the low melting point component are caused to occupy predetermined divisional areas at alternate intervals within the cross section of the filament, each divisional area extending from the center of the filament cross-section to the circumference thereof, the high melting point component and the low melting point component being each arranged in equally divided condition.

29. A method of manufacturing a biodegradable filament nonwoven fabric as set forth in claim 27, wherein a hollow portion is formed in the filament, and wherein the high melting point component and the low melting point component are caused to occupy predetermined divisional areas at alternate intervals within the cross section of the filament, each divisional area extending from the hollow portion to the circumference of the cross section, the high melting point component and the low melting point component being each arranged in equally divided condition, and wherein both the high melting point component and the low melting point component are exposed to the hollow portion.

30. A method of manufacturing a biodegradable filament nonwoven fabric as set forth in claim 27, wherein the low melting point component is caused to define a center portion in the cross section of the filament, and wherein the high melting point component is caused to define a plurality of independent projections arranged along the circumferential edge of the low melting point component.

31. A method of manufacturing a biodegradable filament nonwoven fabric as set forth in claim 27, wherein the nonwoven web is subjected to partial bonding with heat and pressure.

32. A method of manufacturing a biodegradable filament nonwoven fabric as set forth in claim 31, wherein the partial bonding with heat and pressure is effected by an embossing roll.

33. A method of manufacturing a biodegradable filament nonwoven fabric as set forth in claim 32, wherein with the melting point of the low melting point component set at (Tm)°C., bonding with heat and pressure is effected at a temperature within the range of from (Tm−25)°C. to (Tm) °C.

34. A method of manufacturing a biodegradable filament nonwoven fabric as set forth in claim 31, wherein the partial bonding with heat and pressure is effected by a pinsonic processing apparatus by means of ultrasonic wave.

35. A method of manufacturing a biodegradable filament nonwoven fabric as set forth in claim 27, wherein a crystallizing agent is loaded at least into the low melting point component of the constituents of the filament.

36. A method of manufacturing a biodegradable filament nonwoven fabric as set forth in claim 35, wherein the crystallizing agent is added to the low melting point component and, when required, to the high melting point component, and wherein assuming that where the crystallizing agent is added to the high melting point component, the amount of that addition is QA (wt %) ($0 \leqq QA$), and that the amount of the crystallizing agent added to the low melting point component is QB (wt %) ($0 < QB$), the crystallizing agent loadings satisfy the following equations (1) and (2):

$$[(\Delta TA+\Delta TB)/100]-2/3 \leqq QA+QB \leqq [(\Delta TA+\Delta TB)/100]+4 \quad (1)$$

$$QA \leqq QB \quad (2)$$

where,

ΔTA=(melting point (°C.) of high melting point component)−(crystallizing temperature (°C.) of high melting point component)≧35;

ΔTB=(melting point (° C.) of low melting point component)−(crystallizing temperature (° C.) of low melting point component)≧35.

37. A method of manufacturing a biodegradable filament nonwoven fabric as set forth in claim 27, wherein for the high melting point component and/or the low melting point component is used a polymer or polymers selected from the group consisting of poly(ethylenesuccinate), poly(butylenesuccinate), poly(butyleneadipate), poly(butylenesebacate), poly(lactic acid), and copolymer polyesters composed of their repeating units.

38. A method of manufacturing a biodegradable filament nonwoven fabric as set forth in claim 27, wherein for the high melting point component and/or the low melting point component is used a blend of two or more polymers selected from the group consisting of poly(ethylenesuccinate), poly(butylenesuccinate), poly(butyleneadipate), poly(butylenesebacate), poly(lactic acid), and copolymer polyesters composed of repeating units of these polymers.

39. A method of manufacturing a biodegradable filament nonwoven fabric as set forth in claim 38, wherein the blend ratio of the one polymer to be blended to the other is from 10/90 to 90/10 in weight.

40. A method of manufacturing a biodegradable filament nonwoven fabric as set forth in claim 28, wherein the melt flow rate of the high melting point component is from 20 to 70 g/10 min. and that of the low melting point component is from 15 to 50 g/10 min., as measured according to the method described in ASTM-D-1238 (E).

41. A method of manufacturing a biodegradable filament nonwoven fabric as set forth in claim 29, wherein the melt flow rate of the high melting point component is from 20 to 70 g/10 min. and that of the low melting point component is from 15 to 50 g/10 min., as measured according to the method described in ASTM-D-1238 (E).

42. A method of manufacturing a biodegradable filament nonwoven fabric as set forth in claim 30, wherein with respect to both the high melting point component and the low melting point component, the melt flow rate is from 1 to 100 g/10 min. as measured according to the method described in ASTM-D-1238 (E).

43. A method of manufacturing a biodegradable filament nonwoven fabric as set forth in claim 42, wherein the melt flow rate of the high melting point component is from 15 to 50 g/10 min. and that of the low melting point component is from 20 to 70 g/10 min., as measured according to the method described in ASTM-D-1238 (E).

44. A method of manufacturing a biodegradable filament nonwoven fabric as set forth in claim 27, wherein the compound ratio of the high melting point component/low melting point component in the process of melt-spinning is from 1/3 to 3/1 in weight.

45. A method of manufacturing a biodegradable filament nonwoven fabric as set forth in claim 28, wherein the high melting point component and the low melting point component are each arranged in such a condition as divided into 3 to 20 elements within the cross section of the filament; wherein individual elements of the high melting point and low melting point components are made to have a fineness of from 0.05 to 1.0 denier; and wherein a single yarn of filaments comprised of the high melting point and low melting point components is made to have a fineness of from 1.5 to 10 denier.

46. A method of manufacturing a biodegradable filament nonwoven fabric as set forth in claim 29, wherein the high melting point component and the low melting point component are each arranged to be divided into 3 to 20 elements within the cross section of the filament; wherein individual elements of the high melting point and low melting point components are made to have a fineness of from 0.05 to 1.0 denier; and wherein a single filament comprised of the high melting point and low melting point components is made to have a fineness of from 1.5 to 10 denier.

47. A method of manufacturing a biodegradable filament nonwoven fabric as set forth in claim 30, wherein the number of projections of the high melting point component is from 4 to 10; wherein individually independent elements of the high melting point component are made to have a fineness of from 0.05 to 2 denier; and wherein a single filament comprised of the high melting point and low melting point components is made to have a fineness of from 1.5 to 10 denier.

* * * * *